US006232920B1

(12) United States Patent
Brookner et al.

(10) Patent No.: US 6,232,920 B1
(45) Date of Patent: May 15, 2001

(54) ARRAY ANTENNA HAVING MULTIPLE INDEPENDENTLY STEERED BEAMS

(75) Inventors: Eli Brookner, Lexington; Richard L. O'Shea, Holliston; Jack Jerome Schuss, Newton; Jeffrey C. Upton; John R. Mather, both of Groton; Michael G. Sarcione, Millbury; William J. Payne, Wayland, all of MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/603,591

(22) Filed: Jun. 26, 2000

Related U.S. Application Data

(63) Continuation of application No. 09/007,156, filed on Jan. 4, 1998, now Pat. No. 6,104,343.

(51) Int. Cl.[7] ..... H01Q 3/22; H01Q 13/00
(52) U.S. Cl. ..... 342/372; 343/778
(58) Field of Search ..... 342/372; 343/778

(56) References Cited

U.S. PATENT DOCUMENTS

| | | | |
|---|---|---|---|
| 4,408,205 | 10/1983 | Hockham | 343/16 R |
| 4,720,712 | 1/1988 | Brookner et al. | 342/383 |
| 4,962,383 | 10/1990 | Tresselt | 343/700 MS |
| 5,598,173 * | 1/1997 | LoForti et al. | 342/372 X |
| 5,812,088 | 9/1998 | Pi et al. | 342/373 |
| 5,812,089 | 9/1998 | Locke | 342/373 |

FOREIGN PATENT DOCUMENTS

| | | | |
|---|---|---|---|
| 0727839 | 8/1996 | (EP) | H01Q/1/00 |
| 0834955 | 9/1997 | (EP) | H01Q/21/00 |
| 0801437 | 10/1997 | (EP) | H01Q/25/00 |

OTHER PUBLICATIONS

A. I. Zaghloul et al., "X–Band Active Transmit Phased Array for Satellite Applications", COMSAT Laboratories, 1996, pp. 272–277.

* cited by examiner

*Primary Examiner*—Mark Hellner
(74) *Attorney, Agent, or Firm*—Daly, Crowley & Mofford, LLP

(57) ABSTRACT

An array antenna system for forming multiple independently steered beams is described. The antenna system includes series or parallel feed circuits and phase shifters which are not disclosed directly in the signal path between the feed circuits and antenna elements included in the array antenna system.

9 Claims, 14 Drawing Sheets

ARRAY ANTENNA HAVING MULTIPLE INDEPENDENTLY STEERED BEAMS

RELATED APPLICATIONS

This application is continuation of U.S. patent application Ser. No. 09/007,156, filed Jan. 14, 1998, now U.S. Pat. No. 6,104,343.

GOVERNMENT RIGHTS

Not applicable.

1. Field of the Invention

This invention relates generally to radio frequency (RF) antennas and more particularly to RF array antennas.

2. Background of the Invention

As is known in the art, a phased array antenna is a directive antenna made up of a plurality of individual radiating antenna elements, which generate a radiation pattern or antenna beam having a shape and direction determined by the relative phases and amplitudes of the excitation signal associated with the individual antenna elements. By properly varying the relative phases of the respective excitation signals, it is possible to steer the direction of the antenna beam. The radiating antenna elements may be provided as dipole antenna elements, open-ended waveguides, slots cut in waveguides, printed circuit antenna elements or any type of antenna element.

The array antenna thus includes of a number of individual radiating antenna elements suitably spaced with respect to one another. The relative amplitude and phase of the signals applied to each of the antenna elements are controlled to obtain the desired radiation pattern from the combined action of all of the antenna elements. Two common geometrical forms of array antenna are the linear array and the planar array. A linear array antenna includes a plurality of antenna elements arranged in a straight line in one dimension. A planar array antenna is a two-dimensional configuration of antenna elements arranged to lie in a plane. The planar array antenna may thus be thought of a linear array of linear array antennas.

The linear array antenna generates a fan beam when the phase relationships are such that the direction of radiation is perpendicular to the array. When the radiation is at some angle other than perpendicular to the array, the linear array antenna generates an antenna beam having a conical shape.

A two-dimensional planar array antenna having a rectangular aperture can produce an antenna beam having a fan-shape. A square or a circular aperture can produce an antenna beam having a relatively narrow or pencil shape. The array can be made to simultaneously generate many search and/or tracking beams with the same aperture.

One particular type of phased array antenna in which the relative phase shift between antenna elements is controlled by electronic devices is referred to as an electronically controlled or electronically scanned phased array antenna. Electronically scanned phased array antennas are typically used in those applications where it is necessary to shift the antenna beam rapidly from one position in space to another or where it is required to obtain information about many targets at a flexible data rate. In an electronically scanned phased array, the antenna elements, the transmitters, the receivers, and the data processing portions of the radar are often designed as a unit.

In some applications, it is desirable to provide an antenna system capable of producing multiple, independent antenna beams. Such antenna systems are advantageous in a variety of different applications such as communication satellites, ECM, ESM radar and shared aperture antennas used to accomplish simultaneously a combination of these functions. In communication satellite applications, for example, the simultaneous objectives of relatively high EIRP (Equivalent Isotropically Radiated Power) and G/T (Gain over System Temperature), wide access footprints, channelized operation and a high spectral efficiency (i.e., frequency reuse) leads to the need for multiple, independent antenna beams. It is relatively difficult to provide an electronically scanned phased array antenna capable of producing multiple independent antenna beams due to the interaction between the signals of the multiple antenna beams and the complexity of the multiple beamformer circuitry necessary to produce such multiple independent antenna beams.

The requirement for the phase array designer is made even more difficult when the operating frequency is selected to have a relatively high operating frequency in the frequency range of 20 to 30 GHz, for example, due to the corresponding decrease in the spacing between the antenna elements required for operation at that frequency. The problem is further exacerbated when it is desirable to provide a compact antenna system operating at a relatively high frequency range since the relatively small spacing between antenna elements and the need to couple feed circuits to the antenna elements result in difficult packaging requirements.

One approach to provide an antenna system having a relatively high operating frequency and multiple independent antenna beams is to utilize a lens or dish antenna which includes a separate feed circuit for each separate antenna beam. However, such an approach is relatively inflexible and it is relatively difficult to change the directions of the individual antenna beams. Thus, there is a significant interest in phased array antennas and in particular in electronically scanned phased array antennas.

It would, therefore, be desirable to provide an antenna capable of producing multiple independently steered antenna beams and which is compact, relatively low loss, and which consumes a relatively small amount of power. It would also be desirable to provide an electronically scanned phased array antenna capable of steering multiple independent antenna beams.

It would further be desirable to provide an electronically scanned phased array antenna in which failure of one phase shifter only affects one antenna beam and the one antenna element associated with the antenna beam. It would also be desired to provide an antenna in which there is no cascading of the amplitude and phase errors of phase shifters included in the phased array antenna.

SUMMARY OF THE INVENTION

In accordance with the present invention, an array antenna system for forming multiple independently steered beams includes an array of antenna elements, a first plurality of series feed signal paths each of the first plurality of series feed signal paths coupled to one of the antenna elements, a plurality of phase shifters each of the plurality of phase shifters having a first phase shifter port coupled to first ones of a plurality of couplers and with each of the first ones of the plurality of couplers disposed to couple a signal from a corresponding one of the first plurality of series feed signal paths and having a second phase shifter port coupled to second ones of the plurality of couplers with each of the second ones of the plurality of couplers disposed to couple a signal from the second phase shifter ports to a corresponding one of a second plurality of series feed signal paths and a signal combiner for combining the signals to provide one or more antenna beams.

With this particular arrangement, an antenna capable of providing multiple independent antenna beams is provided. The antenna may be provided as an electronically controlled phased array antenna which includes an electronic device for controlling a relative phase shift between antenna elements such as electronically controlled phase shifters. By disposing the phase shifters such that they are not directly in the antenna element feed circuit signal paths, the phase shifter settings for the $i^{th}$ beam are independent of that from the $j^{th}$ beam. The failure of one phase shifter only effects a single beam as a failure of only one element. Furthermore, the phase shifter amplitude and phase errors as well as losses do not cascade. Moreover, the signal from one antenna element propagates through only one phase shifter to form the antenna beam before the signals for that antenna beam are summed. Hence, the antenna is provided as a relatively low loss antenna. Finally, by appropriately arranging phase shifters and couplers in the feed circuit, coupling between the multiple antenna beams is minimized. That is, the power from beam the $i^{th}$ does not couple to beam the $j^{th}$ as it does in prior art techniques. It should be noted that the technique may be used to provide both receive and transmit array antenna systems.

In accordance with a further aspect of the present invention, an array antenna system for forming multiple independently steered beams includes an array of antenna elements, a first plurality of parallel feed signal paths each of the first plurality of parallel feed signal paths coupled to one of the antenna elements, a plurality of phase shifters each of the plurality of phase shifters having a first phase shifter port coupled to predetermined ones of the first plurality of parallel feed signal paths and having a second phase shifter port coupled to second plurality of parallel feed signal paths. Each of the second plurality of parallel feed signal paths coupled to a corresponding one of a plurality a signal combiners for combining the signals to provide one or more antenna beams.

With this particular arrangement, an antenna capable of providing multiple independent antenna beams is provided. The parallel feed signal paths may be provided as corporate power dividers or series feed lines and signal combiners. The antenna may be provided as an electronically controlled phased array antenna which includes electronically controlled phase shifters. By disposing the phase shifters such that they are not directly in the antenna element feed circuit signal paths, the phase shifter settings for the $i^{ith}$ beam are independent of that from the $j^{th}$ beam. The failure of one phase shifter only effects a single beam as a failure of only one element. Furthermore, the phase shifter amplitude and phase errors as well as losses do not cascade. Moreover, the signal from one antenna element propagates through only one phase shifter to form the antenna beam before the signals for that antenna beam are summed. Hence, the antenna is provided as a relatively low loss antenna. Finally, by appropriately arranging phase shifters and parallel signal divider circuits in the feed circuit, coupling between the multiple antenna beams is minimized. That is, the power from beam the $i^{th}$ does not couple to beam the $j^{th}$ as it does in prior art techniques. It should be noted that the technique may be used to provide both receive and transmit array antenna systems.

In accordance with a still further aspect of the present invention, in one particular embodiment a beam/element grid junction for use in a phased array antenna includes a first directional coupler having a first port, a second port, a third port and a fourth port, a phase shifter having a first port coupled to the third port of the directional coupler and having a second port and a second directional coupler having a first port coupled to the second port of the phase shifter and having a second port, a third port and a fourth port. With this particular arrangement, the beam/element grid junction can be coupled to an antenna element feed circuit such that phase shifter is not directly in the antenna element feed circuit signal path. Thus, the phase shifter setting for one antenna element in an array of antenna elements can be controlled independently of the phase shifter settings for the other antenna elements in the array. The beam/element grid junction may thus further include an antenna element coupled to a first port of the first directional coupler and a transmitter can be coupled to a first port of the second directional coupler to provide a transmit system. Alternatively or in addition to the transmitter coupled to the second directional coupler, a signal combiner can be coupled to a second port of the second coupler and a receiver can be coupled to an output port of the signal combiner. With this arrangement a transmit/receive or a receive only system can be provided.

BRIEF DESCRIPTION OF THE DRAWINGS

The foregoing features of this invention as well as the invention itself may be more fully understood from the following detailed description of the drawings in which.

DESCRIPTION OF THE PREFERRED EMBODIMENTS

Figure 1:
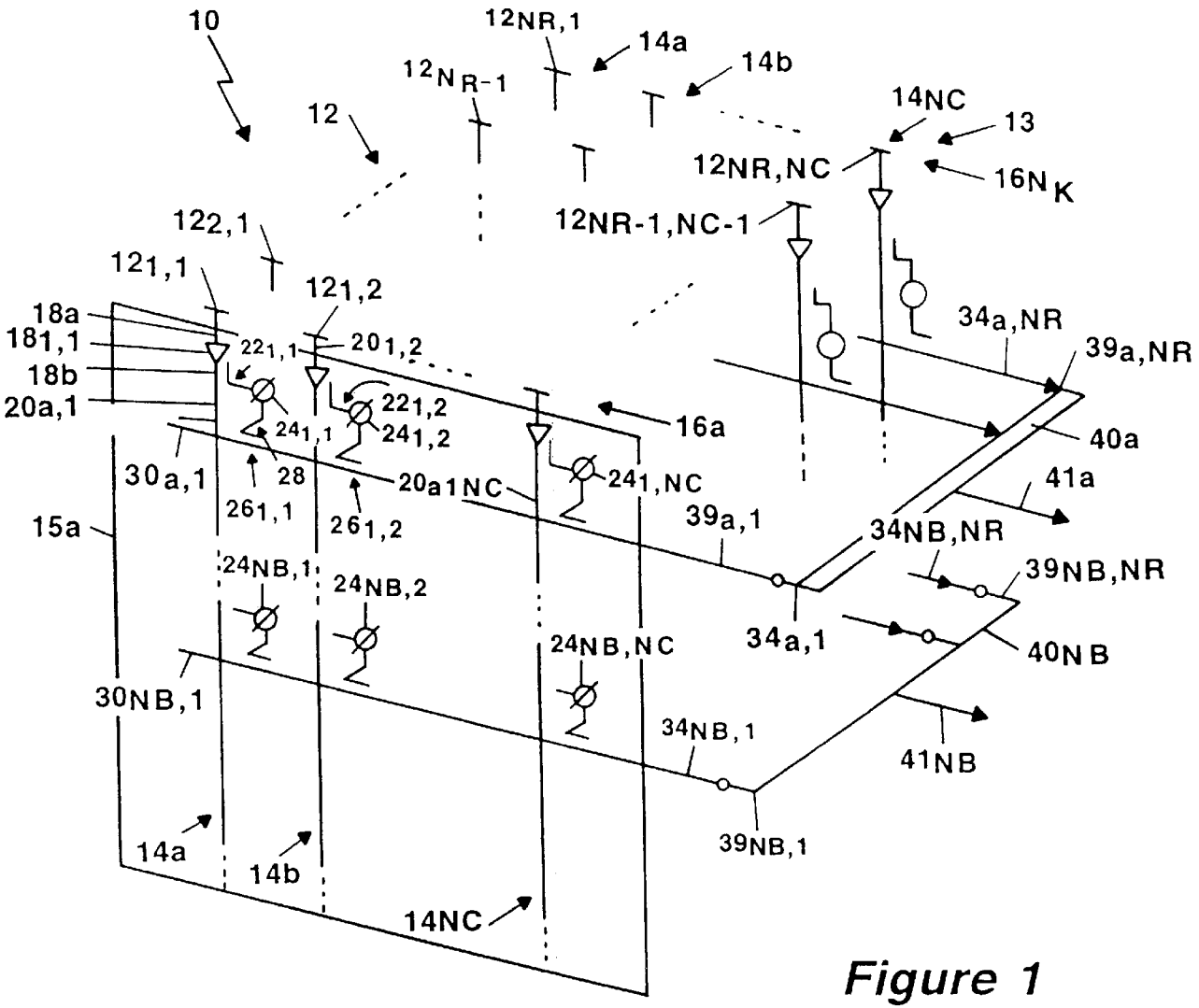
FIG. 1 is a schematic diagram of a multi-beam system using series feeds and parallel phase shifters to form independently steered antenna beams.

Referring now to FIG. 1, a two-dimensional phased array antenna system 10 capable of forming a plurality (e.g., 64)

of independently steered antenna beams includes a plurality of antenna elements generally denoted 12 disposed to here provide a planar array antenna 13. The antenna system 10 includes array columns 1*a*–14$N_c$ generally denoted 14 and array rows 16*a*–16$N_R$ generally denoted 16. The plurality of antenna elements 12 are thus arranged as an array having $N_C$ columns and $N_R$ rows (FIG. 2B). Using the above notation, the antenna element located at the intersection of the first position in the first column 14*a* and the first position in the first row 16*a* is thus denoted $\mathbf{12}_{1,1}$ and the antenna element located at the intersection of the last position of the last column 14$N_C$ and the last position of the last row 16$N_R$ is denoted $\mathbf{12}_{NR,NC}$.

It should be noted that although the description provided hereinbelow describes the inventive concepts in the context of a planar array antenna 13, those of ordinary skill in the art will appreciate that the concepts equally apply to other types of array antennas including, but not limited to, arbitrary shaped planar array antennas as well as cylindrical, conical, spherical and arbitrary shaped conformal array antennas. Also, reference is sometimes made herein to generation of an antenna beam having a pencil shape. Those of ordinary skill in the art will appreciate, of course, that antenna beams having other shapes may also be used and may be provided using well-known techniques such as by inclusion of attenuators into appropriate locations in a feed circuit, for example.

To form an output signal for a first antenna beam (referred to herein as beam 1) an output port of the antenna element $\mathbf{12}_{1,1}$ is coupled to a row board 15*a*. Row board 15*a* includes an amplifier 18 which may be provided, for example, as a low noise amplifier (LNA) $\mathbf{18}_{1,1}$ at an input port 18*a*. An output port 18*b* of LNA $\mathbf{18}_{1,1}$ is coupled to a first series feed signal path $\mathbf{20}_{a,i}$. Thus, LNA 18 receives a signal from the antenna element $\mathbf{12}_{1,1}$ and provides an amplified signal to the series feed signal path $\mathbf{20}_{a,1}$.

Series feed signal path $\mathbf{20}_{a,1}$ may be provided as a stripline transmission line, a microstrip transmission line, an air or dielectric filled waveguide transmission line disposed over a conducting plane, a ridge waveguide transmission line or any other type of transmission line which may be provided using any technique well known to those of ordinary skill in the art to provide a signal path transmission line. The particular manner in which the signal path $\mathbf{20}_{a,1}$ is provided will be selected in any particular application after consideration of a variety of factors including but not limited to the desired operating frequency of the antenna, the ease with which a particular technology can be manufactured, transmission line insertion loss, bandwidth of the signals, as well as the size, weight and cost of materials and fabrication of a particular type of transmission line.

A first coupler $\mathbf{22}_{1,1}$ couples a portion of the signal propagating along series feed signal path $\mathbf{20}_{a,1}$ and to a first or input port of a phase shifter $\mathbf{24}_{1,1}$. Phase shifter $\mathbf{24}_{1,1}$ introduces into the signal fed thereto a predetermined phase shift $Ø_{1,1}$.

A second or output port of phase shifter $\mathbf{24}_{1,1}$ is coupled through a second coupler $\mathbf{26}_{1,1}$ to a second series signal path $\mathbf{30}_{a,1}$. Signal path $\mathbf{30}_{a,1}$ may be provided as the same type or a different type of transmission line as signal path $\mathbf{20}_{a,1}$. In some embodiments, series feed signal paths $\mathbf{20}_{a,1}$, $\mathbf{30}_{a,1}$ are disposed on different layers of the same printed circuit board 15*a*. Thus, in this case an RF feedthrough 28 couples the signal from a layer of the printed circuit board on which series feed signal path $\mathbf{20}_{a,1}$ is disposed to a layer of the printed circuit board on which series feed signal path $\mathbf{30}_{a,1}$ is disposed. Similarly, an RF feedthrough or other coupling means would be required if signal paths $\mathbf{20}_{a,1}$, $\mathbf{30}_{a,1}$ were disposed on different printed circuit boards (PCBs) rather than different layers of the same PCB.

In this particular embodiment, the feed circuits $\mathbf{20}_{a,1}$, $\mathbf{30}_{a,1}$ are orthogonally disposed with the first feed circuit 20 here being shown having a generally vertical direction and the second feed circuit here being shown having a generally horizontal direction. It should be appreciated, however, that the relative physical positions between the two signal path feed circuits $\mathbf{20}_{a,1}$, $\mathbf{30}_{a,1}$ need not be orthogonal or have any other particular physical relationship.

The output from phase shifter $\mathbf{24}_{a,1}$ is coupled through a coupler $\mathbf{26}_{1,1}$ to the signal path feed circuit $\mathbf{30}_{a,1}$ which contributes to the formation of a first fan beam (i.e. fan beam number 1) at port $\mathbf{34}_{a,1}$.

In a similar manner, the output from the second antenna element $\mathbf{12}_{1,2}$ of row board 15*a* is fed to the input port of a low noise amplifier (LNA) $\mathbf{18}_{1,2}$. The LNA $\mathbf{18}_{1,2}$ is followed by a second vertically oriented series feed signal path $\mathbf{20}_{a,2}$. The signal from the series feed signal path $\mathbf{20}_{a,2}$ is in turn coupled through a coupler $\mathbf{22}_{1,2}$ to a phase shifter $\mathbf{24}_{1,2}$ where it receives the phase shift $Ø_{1,2}$. The output of the phase shifter $\mathbf{24}_{1,2}$ is in turn coupled (through the second layer of the row board 15*a* if necessary) to the series feed signal path $\mathbf{30}_{a,1}$.

In a similar manner, the outputs of the other antenna elements $\mathbf{12}_{1,3}$–$\mathbf{12}_{NC}$ of row board 15*a* are coupled into this same horizontally running series feed signal path $\mathbf{30}_{a,1}$ (i.e. series feed signal path number 1) to provide the signal at output port $\mathbf{34}_{a,1}$ which forms a first fan beam (i.e. fan beam number 1 for forming pencil beam 1). The other boards, 15*b*–$\mathbf{15}_{NR,}$ provide similar output signals $\mathbf{34}_{a,2}$–$\mathbf{34}_{a,NR.}$ forming fan beams for forming beam number 1 with each such output signals pointing in the same direction.

Next, the output signals at ports $\mathbf{34}_{a,2}$–$\mathbf{34}_{a,NR}$ are fed to respective input ports $\mathbf{39}_{a,1}$–$\mathbf{39}_{a,NR}$ of a signal combiner 40*a*. In some embodiments, it may be desirable to provide signal combiner 40*a* as an isolating signal combiner which includes isolating resistors to isolate the input ports $\mathbf{39}_{a,1}$–$\mathbf{39}_{a,NR}$ from each other. Signal combiner 40*a* combines the individual fan beam signals fed thereto and provides an output signal at a signal combiner output port 41*a*. This is a pencil beam output for beam 1.

In a similar manner signals from antenna elements $\mathbf{12}_{1,1}$–$\mathbf{12}_{1,NC}$ are coupled through respective ones of first series feed signal paths $\mathbf{20}_{a,2}$–$\mathbf{20}_{a,NC}$ to respective ones of second series feed signal paths $\mathbf{30}_{b,1}$–$\mathbf{30}_{NB,1}$. The signals coupled to series signal paths $\mathbf{30}_{b,1}$–$\mathbf{30}_{NB,1}$ propagate toward output ports $\mathbf{34}_{b,1}$–$\mathbf{34}_{NB,1}$ respectively, to provide at output ports $\mathbf{34}_{b,1}$–$\mathbf{34}_{NB,1}$ the signals which form fan beams 2-$N_B$ for forming pencil beams 2-$N_B$.

The remaining rowboards $\mathbf{15}_b$–$\mathbf{15}_{NR}$ coupled to respective antenna element rows $\mathbf{16}_b$–$\mathbf{16}_{NR}$ provide similar output signals $\mathbf{34}_{b,1}$–$\mathbf{34}_{b,NR}$ . . . $\mathbf{34}_{NB,1}$–$\mathbf{34}_{NB,NR}$ for fan beams 2-$N_B$ with each such output signal for a given beam pointing in the same direction but each beam possibly pointing in a different direction (where $N_B$ equals 64 for example) are formed as shown in FIG. 1.

It should be noted that the antenna architecture described above in conjunction with FIG. 1 has the advantage that the phase settings for each of the phase shifters $\mathbf{24}_{ij}$ in the antenna system 10 for beam i is independent of the phase shifter settings for beam j. Also, since the phase shifters $\mathbf{24}_{ij}$ are not coupled in series, the antenna architecture of FIG. 1 has the advantage that the phase shifter amplitude and phase errors as well as insertion losses do not cascade.

To form an antenna beam, the signal from one antenna element (e.g. antenna element $12_{1,1}$) propagates through only one phase shifter (e.g. phase shifter $24_{NB,1}$) before the signal is summed to form an antenna beam (e.g. antenna beam $N_B$). Furthermore, the antenna architecture of FIG. 1 results in an antenna system having relatively low insertion loss characteristics since each signal incurs the losses associated with only a single phase shifter 24. The antenna architecture of the present invention also provides the advantage that the failure of one of the phase shifters 24 only effects a single beam in the same manner that the failure of a single one of the plurality of antenna elements effects an antenna beam. Finally, the antenna architecture described above results in an antenna system in which there is no coupling between multiple antenna beams. That is, the power from beam i does not couple into beam j as it does in other implementations.

Although the implementation described above is for an array antenna operating in a receive mode, the concepts and techniques described above can also be used to provide an array antenna operating in a transmit mode as will be described below in conjunction with FIG. 3.

It should also be noted that the $i^{th}$ beam (out of a possible $N_B$ beams) and therefore the $j^{th}$ row (i.e. the $j^{th}$ row board out of $N_R$ possible row boards) is pointing in the same direction as the $i^{th}$ beam for all the other rows. That is, the $i^{th}$-beam for each of the rows $15a$–$15_{NR}$ are steered to the same angle. For convenience and ease of explanation, this steering direction will be referred to herein as the azimuth direction. The $k^{th}$ beam could be pointing in a different or the same direction as the $i^{th}$ beam.

The $i^{th}$ beam output signals provided at the output port of each of the row boards $16_a$–$16_{NR}$, are combined to form the $i^{th}$ pencil beam from the fan beams of each row (or row board). Towards this end the phase shifters $24_{ij}$ forming the $i^{th}$ beam for the first board are incremented to provide a phase shift setting for the second board 16*b*. Specifically, all the phase shifters $24_{1,1}$ to $24_{1,Nc}$ having phase shifter settings $\emptyset_{11}$ to $\emptyset_{1,NC}$ are shifted nominally by a predetermined phase $\Delta\theta_1$ to steer the beams in the elevation direction. The phase shift $\Delta\theta_1$ nominally would be the same for $\emptyset_{11}$ to $\emptyset_{1,NC}$ It should be noted that the steering actually occurs in sine space rather than in Az-E1 space, but for simplicity and ease of explanation, the operation will be described as if occurring in Az-E1 space. Successive rows 16*b*–16$N_R$ receive the same increase in phase shift $\Delta\theta$, for beam 1 in going from one board to the next. In this way, beam steering to a specified elevation angle is accomplished. As mentioned above, the phase shift $\Delta\theta_1$ nominally could be the same for $\emptyset_{11}$ to $\emptyset_{1,NC}$. However, to shape beam 1 in the elevation direction a different $\Delta\theta_1$, $\Delta\theta_{1,NC}$ could be used for each column.

In one particular embodiment, each row board 15 in the array antenna system 10 is provided from a multilayer printed circuit board. Each row board $15a$–$15_{NR}$ includes circuitry to receive signals from antenna elements 12, and introduces a particular phase shift into each of the signals before combining the signals to form a plurality, here $N_B$, fan antenna beams from the $N_C$ antenna elements of each row. In one particular embodiment, the number of fan beams $N_B$ is chosen to be 64. Those of ordinary skill in the art will appreciate of course that any compatible number of antenna elements and fan beams can be used.

Figure 2:
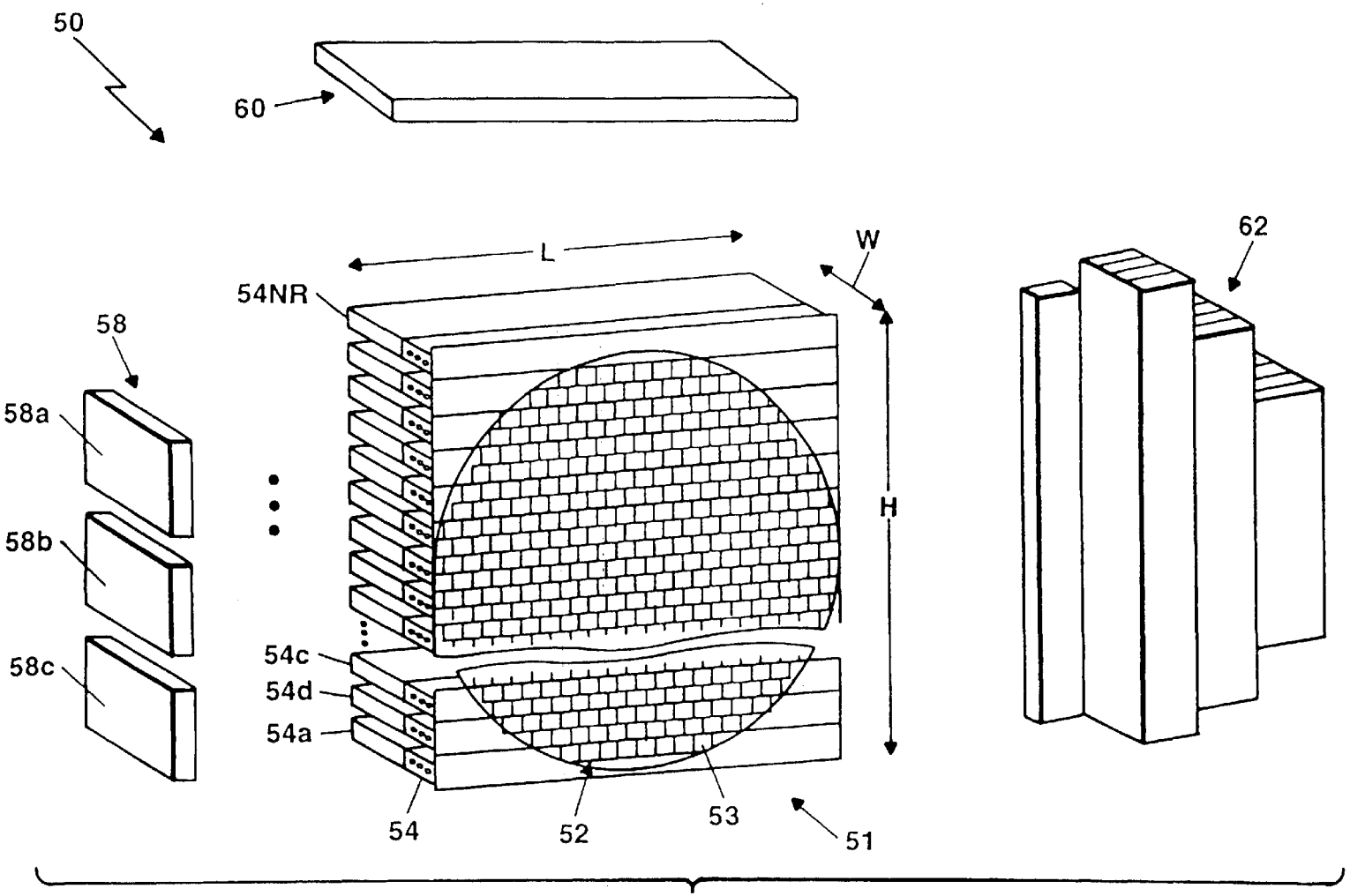
FIG. 2 is a block diagram of an array antenna which provides multiple independently steered antenna beams.

Referring now to FIG. 2, an antenna system 50 includes an array antenna 51 having an array aperture 52. In this particular example, the array aperture 52 is provided having a circular shape. It should be appreciated of course that other aperture shapes including rectangular, square or irregular aperture shapes may also be used. The array antenna 51 is provided from a plurality of beamformer row boards 54*a*–54$N_R$ each of the beamformer row boards 54 coupled to corresponding ones of a plurality of antenna elements 53.

A drive column board assembly 62 is coupled to the beamformer row boards 54 to receive signals from and provide signals to the row boards 54. In a receive mode of operation the drive column boards 62 receive signals from the beamformer row boards 54 and form a receive antenna beam. In a transmit mode of operation, drive column boards 62 provide signals having predetermined amplitudes and phases to the row boards 54. Once the row boards 54 receive the signals, the final phase shift is done via phase shifters disposed on the row boards 54.

Also coupled to phased array antenna 51 are one or more DC-to-DC converters 58*a*–58*c* generally denoted 58. DC-to-DC converters provide appropriately conditioned and filtered DC power signals to those circuit components in the antenna array 51 which require DC power. For example, phase shifters 24 and amplifiers 18 described above in conjunction with FIG. 1 may require DC power. If antenna 51 does not require DC power or if no conversion of DC power is necessary, converters 51 may be omitted.

An array controller 60 is also coupled to the array antenna 51 to thus provide logic signals which control phase shifter settings and in some cases amplitude adjustment circuits thereby controlling the radiation pattern and pointing direction of antenna beams produced by antenna 51. Amplitude adjustment circuits may be used to provide the antenna beam having any shape other than a pencil shape.

Figure 2A:
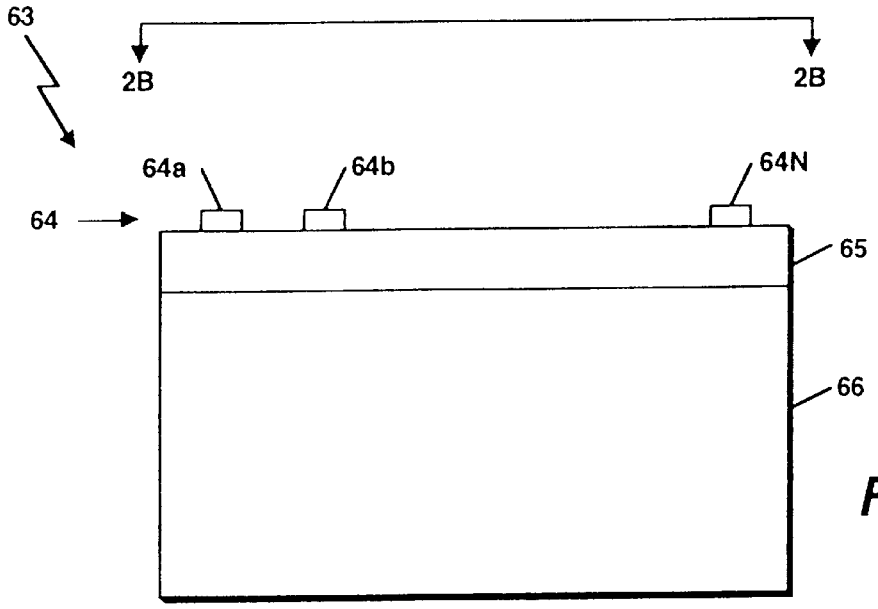
FIG. 2A is a diagrammatical view of a row board of the antenna used in FIG. 2.
Figure 2B:
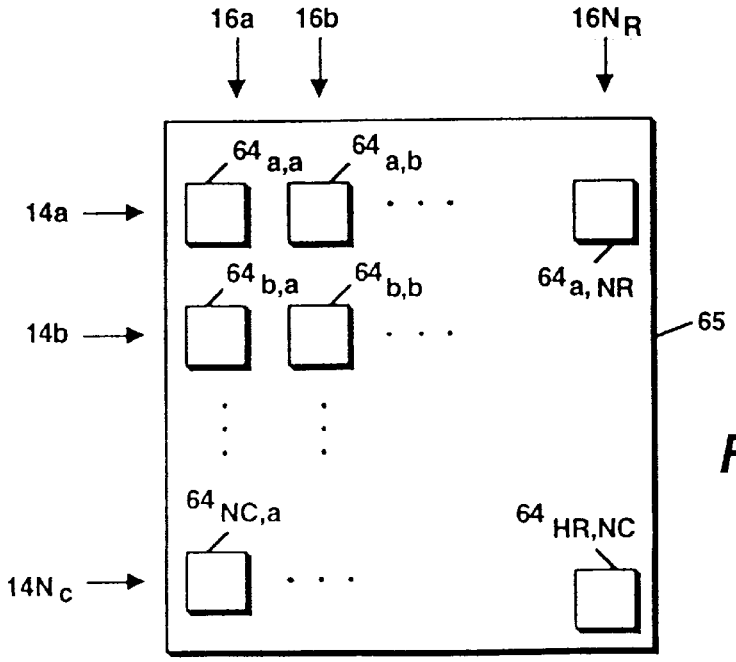
FIG. 2B is a top view taken along lines 2B—2B of FIG. 2A.

Referring now to FIGS. 2A, 2B in which like elements are provided having like reference designations, a beamformer row board 63 is shown having a plurality of antenna elements 64*a*–64N generally denoted 64 disposed thereon. Antenna elements 64 may be provided for example as aperture antenna elements which may be provided from waveguide apertures or from printed circuit antenna elements or dipole elements or notch radiator elements. In one embodiment, antenna elements 64 may be provided as printed circuit aperture antenna elements such as microstrip dipole or microstrip patch antenna elements. Those of ordinary skill in the art will appreciate of course that antenna elements 64 may also be provided from any other type of antenna element well known to those of ordinary skill in the art.

The particular type of antenna element selected for any particular application depends upon a variety of factors including but not limited to the number of antenna elements included in the antenna array, the element peak power, bandwidth needed, volume and weight constraints, operating temperature and environment, the operating frequency of the antenna array (which affects the physical size of each individual antenna element and the physical spacing between antenna elements in the antenna array), the difficulty in manufacturing the particular type of antenna element, the performance characteristic of the antenna element and the desired performance characteristic of the array antenna.

In the embodiment shown in FIGS. 2A, 2B the antenna elements 64 are disposed over a first surface of a first substrate 65. A second surface of substrate 65 is disposed over a second substrate 66. Substrate 66 can be similar to row boards 15 described above in conjunction with FIG. 1 and thus includes antenna element feed circuitry which may, for example, be similar to the feed circuitry described above in conjunction with FIG. 1. The feed circuitry on substrate 66 is electrically coupled to the antenna elements 64. In some implementation the elements of the $i^{th}$ row will be part of the $i^{th}$ row board. For example, in some embodiments it may be advantageous to provide the antenna elements 64 as an integral part of the substrate 66 in which case substrate 65 can be omitted.

Although the antenna elements 64 are here shown having a square shape, those of ordinary skill in the art will also appreciate that the antenna elements 64 may be provided having a rectangular shape, a circular shape, or any other shape including irregular shapes from which an antenna element may be provided. It should be noted that additional circuit board layers would be needed for each row board to provide the control lines and power lines for any circuit component on board 66 which requires DC power and control logic signals.

Figure 3:
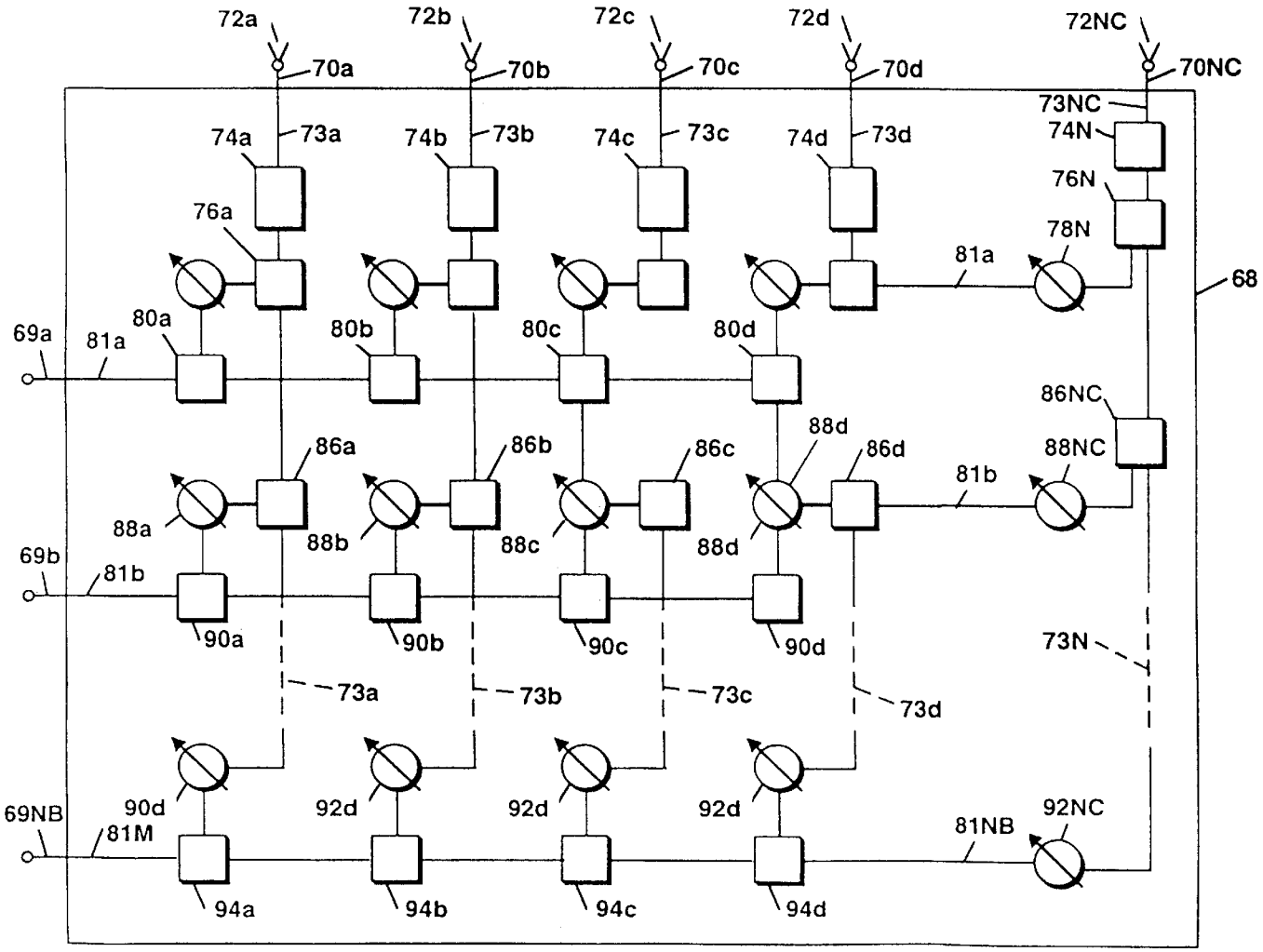
FIG. 3 is a schematic diagram of a beamformer board for use in a transmit antenna system.

Referring now to FIG. 3, a beamformer board 68 for use in a transmit antenna system incudes a plurality of beamports 69*a*–69NB and a plurality of antenna element ports 70*a*–70NC each having a respective one of a plurality of antenna elements 72*a*–72NC coupled thereto. Beamformer board 68 further includes a plurality of series antenna element feed signal paths 73*a*–73NC generally denoted 73 and a plurality of serial beamformer feed signal paths 81*a*–81NB generally denoted 81. The signal path from beamport 69*a* to antenna element 72*a* is representative of the signal paths from each of the beamports 69*b*–69$N_B$ to each of the antenna elements 72*b*–72NC.

A signal is fed through beamport 69*a* through series signal path 81*a* to a first coupling device 80*a*. A portion of the signal is coupled through coupling device 80*a* to a first port of a phase shifter 78*a*. Phase shifter 78*a* introduces a predetermined phase shift to signals fed thereto and provides a phase shifted output signal to a second coupling device 76*a*. Coupling device 76*a* couples a portion of the phase shifted signal from the phase shifter 78*a* to an RF circuit module 74*a* in a second series signal path 73*a*.

In the case where beamformer board 68 is used in a transmit/receive antenna system, the circuit module 74 may be provided as a transmit/receive (TR) module, which thus allows transmission of RF signals from a transmitter (not shown) through beam ports 69*a*–69NB to the RF antenna elements 72 and also allows received RF signals to propagate from antenna elements 72 to ports 69*a*–69NB and subsequently to a receiver (not shown). Alternatively still, in the case where the antenna system 70 is a transmit only system, RF circuit module 74 may be provided as a power amplifier.

A plurality of beamformer boards 68 may be appropriately coupled as described above in conjunction with FIG. 1 to thus provide a planar phased array antenna system. The phase shifter settings may be appropriately selected as discussed above in conjunction with FIG. 1 to provide a plurality of independently steered beams.

Figure 4:
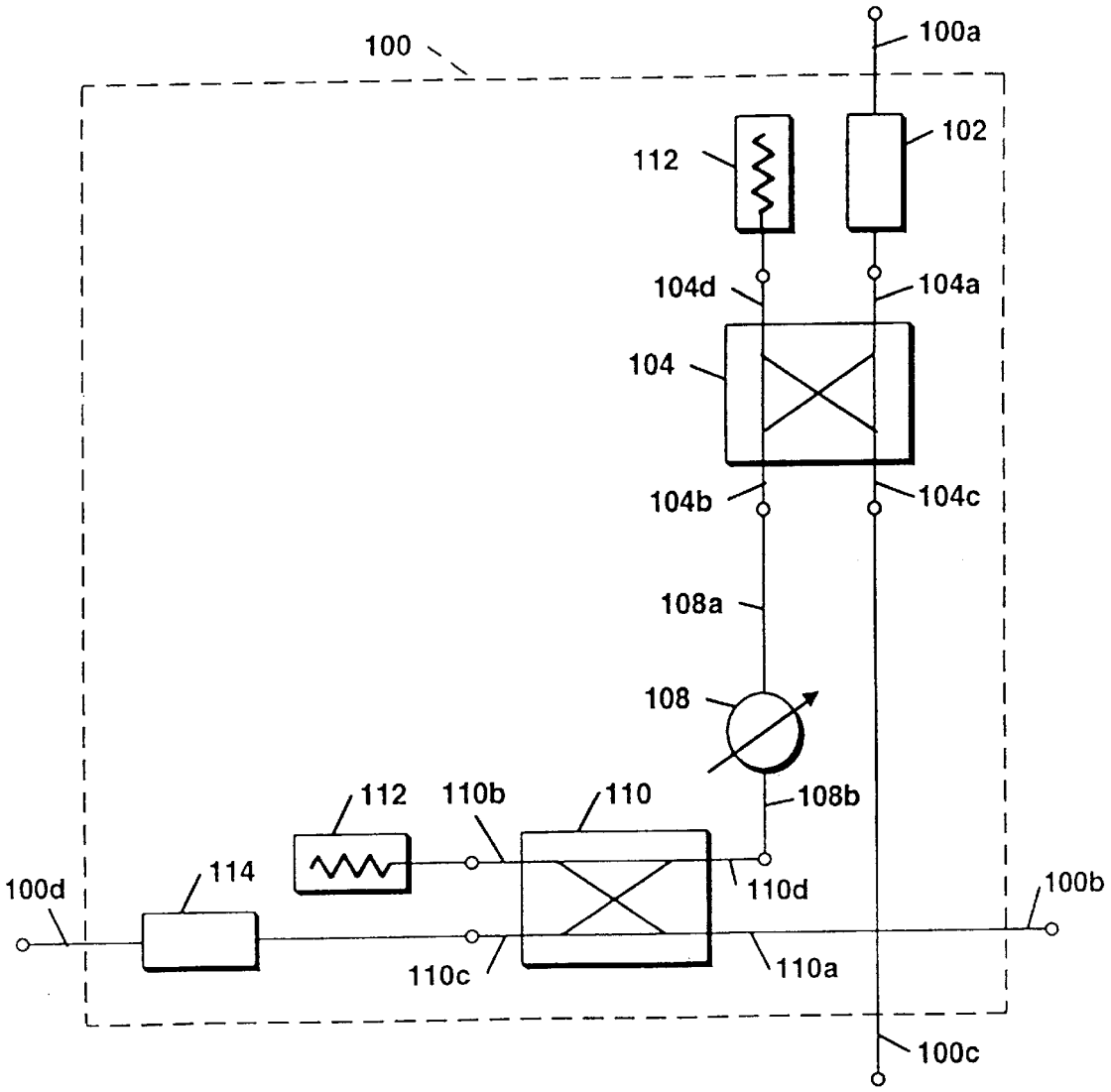
FIG. 4 is a schematic diagram of a beam/element grid junction.

Referring now to FIG. 4, a beam/element grid junction 100 having ports 100*a*–100*d* includes a first transmission line 102 having a first end coupled to port 100*a* and having a second end coupled to a coupling element 104. In this particular example, coupling element 104 is provided as a directional coupler 104 having a first port 104*a* coupled to the second of transmission line 102. Ideally, coupler 104 has the property that in response to a signal incident at port 104*a* the coupler couples power to ports 104*b*, 104*c* but not into port 104*d*. Thus, with port 104*a* corresponding to an input port, port 104*d* is said to be uncoupled or isolated from port 104*a*.

Similarly, in response to a signal incident at port 104*b*, the coupler 104 couples power to ports 104*a* and 104*d* but not into port 104*c*. Thus, with port 104*b* corresponding to an input port, port 104*c* is said to be uncoupled or isolated from port 104*b*.

Coupler port 104*b* is coupled to a first port 108*a* of a phase shifter 108 and a second phase shifter port 108*b* is coupled to a first port 110*d* of a second directional coupler 110. Ideally, coupler 110 has the property that in response to a signal incident at port 110*d*, the coupler 110 couples power to ports 110*b* and 110*c* but not into port 110*a*. Thus, with port 110*d* corresponding to an input port, port 110*a* is isolated from port 110*d*.

Similarly, in response to a signal incident at port 110*c*, the coupler couples power to ports 110*a*, and 110*d* but not into port 110*b*. Thus, with port 110*c* corresponding to an input port, port 110*b* is said to be uncoupled or isolated from port 110*c*.

Termination 112 is coupled to ports 104*d* and 110*b*. A transmission line 114 has a first end coupled to coupler port 110*c* and a second end coupled to element junction port 100*d*.

When element junction 100 is included in a transmit array antenna, the element junction 100 operates in the following manner. A transmit signal incident at port 100*d* propagates along signal path 114 to coupler port 110*c*. The signal is coupled to ports 110*d* and 100*a* while port 110*b* is isolated from port 110*c* and thus, no signal propagates thereto. In a practical coupler, however, a portion of the energy is coupled to port 110*d* and thus, termination 112 terminates any energy propagating to port 110*b*. The portion of the signal coupled to port 110*a* is fed to element junction port 100*b* and may be either terminated or possible fed to a signal path such as signal path $\mathbf{30}_{a,1}$ described above in conjunction with FIG. 1. The portion of the signal coupled to coupler 110*d* is coupled through phase shifter 108 which provides a predetermined phase shift to the signal and is subsequently fed to an input port 104*b* of coupler 104. The signal provided to port 104*b* is coupled between ports 104*a* and 104*d* with port 104*c* being isolated. The termination 112 terminates the energy propagating from port 104*b* to port 104*d*. The signal propagating to port 104*a* is coupled through transmission line 102 to grid element junction port 100*a* and possibly fed to a transmit antenna element such as element 12 described above in conjunction with FIG. 1 or to a signal path such as one of the signal paths described above in conjunction with FIG. 1.

In a receive mode of operation, the receive signal (e.g. from a receive antenna element or from a signal path such as one of the signal paths 20 described above in conjunction with FIG. 1) is fed to element junction port 100*a* through signal path 102 to port 104*a* of coupler 104. The signal is coupled from port 104*a* to ports 104*b* and 104*c* with port 104*d* being isolated. Ideally, no signal should appear at isolated port 104*d*. In a practical coupler, however, a portion of the signal appears at port 104*d* and thus the termination 112 terminates this energy. The signal at port 104*c* propagates to element junction grid port 100*c* and may be either terminated or possibly fed to a signal path such as one of the signal paths 20 described above in conjunction with FIG. 1. The signal fed to port 104*b* is coupled through phase shifter 108 which introduces a predetermined phase shift and is subsequently coupled to port 110*d* of coupler 110.

The signal is coupled from port 100*d* to ports 110*b*, 110*c* of coupler 110 with port 110*a* being isolated. The termination 112 terminates the signal propagating at port 110*b* and the signal coupled to port 110*c* propagates through transmission line 114 to element grid junction port 100*d* and may be fed to a receiver, another signal path, a signal combiner or to another processing circuit for further processing. It should be noted that in a transmit mode of operation, transmit signals fed to grid/element junction port 100*d* do not propagate toward grid/element junction port 100*c* since coupler port 104*c* is isolated from coupler port 104*b*.

Similarly, in a receive mode of operation, receive signals fed to grid/element junction 100*a* do not propagate toward grid/element junction port 100*b* since coupler port 110*a* is isolated from coupler port 110*d*.

It should also be noted that in some embodiments it may be desirable to insert amplitude adjust elements on either side of phase shifter 108 or in the appropriate signal paths between transmission line 114 and coupler port 110*c* or between transmission line 102 and coupler port 104*a* or at any of the appropriate ports of couplers 104, 110 or at any of the grid element junction ports 110*a*–100*d*. In this manner, element grid junction can provide both amplitude and phase control of signals fed thereto. It should further be noted that DC power and control lines have been omitted for clarity but that phase shifter 108 may be provided as a commercially available phase shifter which operates at the desired frequency and which provides the requisite phase shift and that those of ordinary skill in the art understand how to provide power and control signals to such devices.

Figure 5:
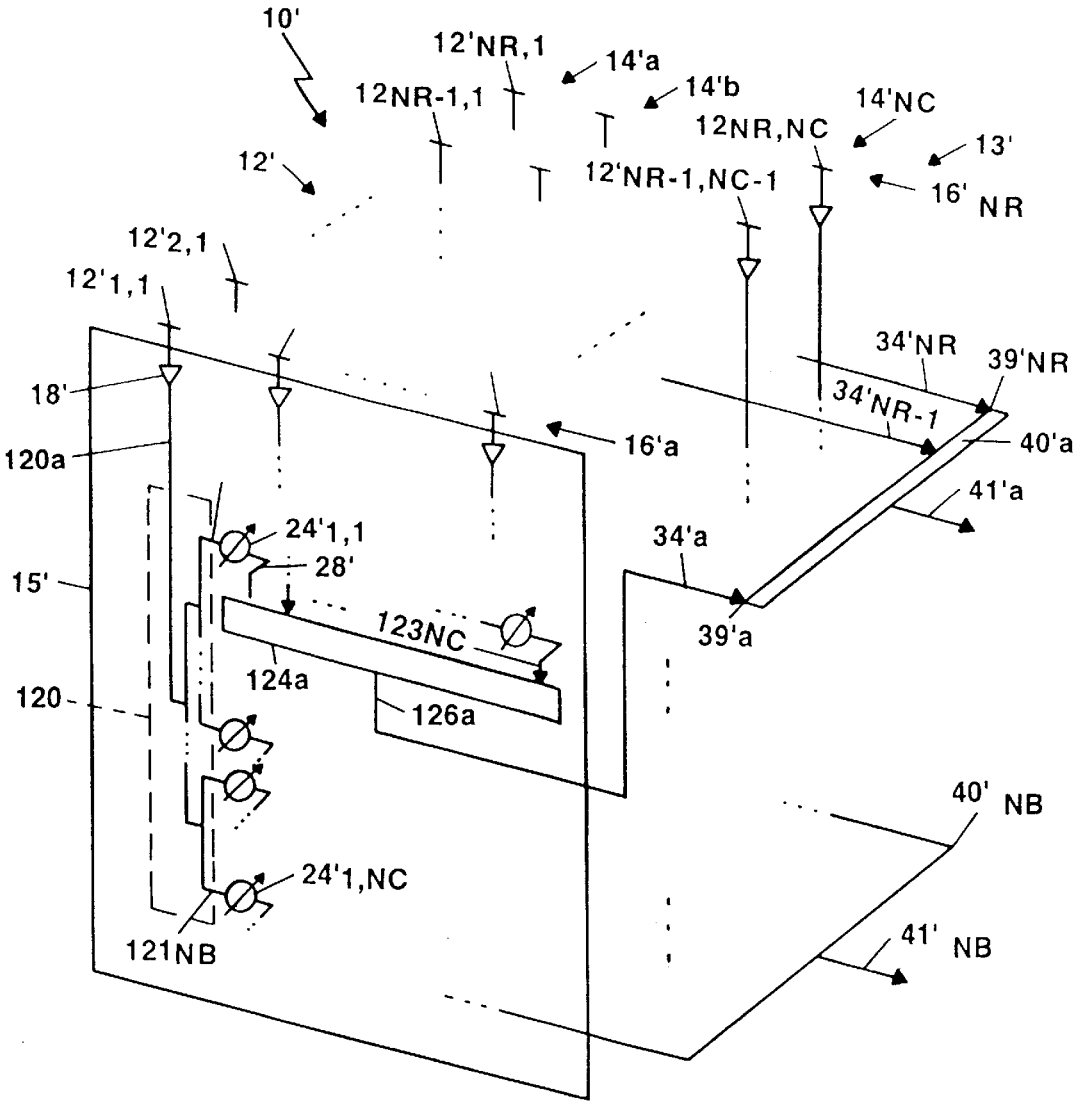
FIG. 5 is a schematic diagram of a receive multi-beam antenna system using corporate combiners and parallel phase shifters to form multiple independently steered antenna beams.

Referring now to FIG. 5, an alternate implementation of an antenna system having the same independent beam characteristic as antenna system 10 in FIG. 1 is shown. FIG. 5 shows a two-dimensional or planar phased array antenna system 10' capable of forming multiple, independently steered antenna beams includes a plurality of antenna elements generally noted 12' disposed to provide a planar array antenna 13'. The antenna system 10' includes array columns 14'*a*–14'$N_C$, generally denoted 14', array rows 16'*a*–16'$N_R$, generally denoted 16' and rowboards 15'. The plurality of antenna elements 12' are thus arranged as an array having NC columns and NR rows as described above in conjunction with FIG. 1.

Each of the plurality of rowboards 15' in the array 13' may be provided as a multi-layered printed circuit board. Each row board 15' forms $N_B$ fan beams from the $N_C$ antenna elements of each row. The antenna 10' is thus similar to antenna 10 described above in conjunction with FIG. 1. Antenna 10 in FIG. 1 utilized series feed signal paths 20, 30 and couplers $\mathbf{22}_{i,j}$, $\mathbf{26}_{ij}$ to provide properly amplitude adjusted signals which are combined to form antenna beams. Antenna 10' of FIG. 5 on the other hand, includes a corporate power divider 120 which receives signals from low noise amplifier 18' at an input port 120*a* and distributes the power at a plurality of output ports 121*a*–121NB. Each of the output ports 121*a*–121NB feeds a respective one of phase shifters $\mathbf{24'}_{1,1}$–$\mathbf{24'}_{NB,NC}$. It should be noted that in the embodiment of FIG. 5, no couplers are needed between the feed line 120 and the phase shifters 24'.

Selected groups of phase shifters $\mathbf{24'}_{1,1}$–$\mathbf{24'}_{1,NC}$ feed corresponding ones of a plurality of signals to signal combiners 124*a*–124NB. In some embodiments, it may be desirable to provide signal combiners 124*a*–124NB as isolating combiners with isolation resistors. Here, for clarity, only a single combiner 124*a* is shown. The signals are fed from phase shifters 24' through optional RF feedthrough circuits 28' to respective input ports of the signal combiner 124*a* at input ports 123*a*–123$N_C$. Signal combiner 124*a* combines the signals fed to the input ports thereof and provides a combined output signal at an output port 126*a* which is the fan beam number 1 used to form pencil beam 1. This output corresponds to output $\mathbf{34}_{a,1}$ of FIG. 1. The output port 126*a* is coupled to an input port of a second combiner, 40*a*', at a respective input port 39*a*' thereof. The combiner 40' combines the signals fed thereto at an output port 41*a*' at which an antenna beam (i.e. beam number 1) having a pencil beam shape is provided. This output 41*a*' corresponds to output 41*a* of FIG. 1.

In one particular embodiment, divider 120 is provided as a corporate power divider 120 having a single input port and 64 output ports (e.g. a 1 to 64 corporate divider). Each of the 64 output ports are coupled to a respective one of 64 phase shifters. Thus, the divider 120 drives 64 sets of phase shifters 24'. The phase shifter feed signals to a 64 to 1 corporate combiner used to form 64 antenna fan beams on row board 15' (designated row board number 1) as well as the other row boards.

Thus, antenna 10' utilizes parallel feed signal paths and power dividers. This in contrast to use of a series feed signal paths and couplers as described above in conjunction with FIG. 1.

Also, to combine the outputs of the phase shifters $\mathbf{24'}_{1,1}$ and $_2$, $\mathbf{24'}_{1,NC}$ utilize a plurality of 64 to 1 corporate combiners 124 in contrast to the series feed signal paths 30 and couplers described above in conjunction with FIG. 1. It should also be noted that in the embodiment of FIG. 5, no couplers are coupled to the phase shifter circuit inputs or outputs as was the case in FIG. 1.

Figure 5A:
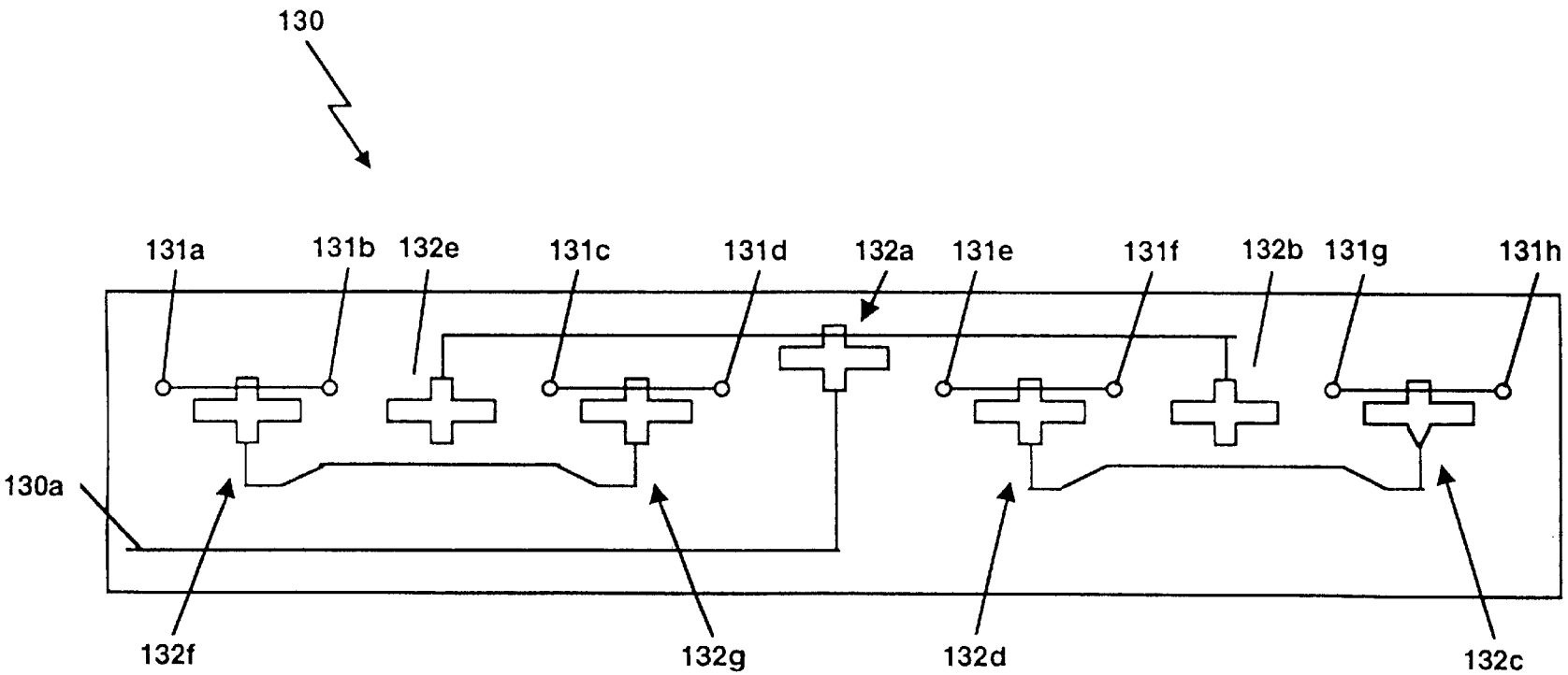
FIG. 5A is a diagrammatical view of a power divider circuit which may be used in the antenna system of FIG. 5.

Referring briefly to FIG. 5A, a corporate divider 130 having an input port 130*a* and a plurality of output ports 131*a*–131*h* is here shown as a 1 folded to 8 corporate divider provided from a plurality of power divider circuits 132*a*–132*g*. By providing the power divider 130 in a folded configuration, the divider is able to fit within the area available between the columns of the antenna elements 12 by reducing the width of the corporate dividers 120 and to reduce the height of the beamformer boards behind the array if desired by reducing the width of the corporate combiners 124. A divider similar to corporate divider 130 having an appropriate number of ports may be used to provide the divider and combiner circuits 120, 124 described in conjunction with FIG. 5. To maintain the compactness of the row boards, corporate divider 130 may include an RF feedthrough to couple signals from a first RF layer to a second RF layer.

With respect to implementing the 64 antenna beam embodiment mentioned above, a printed circuit board using two circuit layers may be required to implement a 1 to 64 divider. Each layer could include a 1 to 8 folded corporate divider similar to divider 130 with an RF feedthrough used to provide and RF signal path from a first RF layer to the a second RF layer on the printed circuit board.

If desired, the 64 to 1 horizontal combiner 124 (FIG. 5) can be implemented in a single layer since the available space is not constrained by the spacings between antenna elements 12' (FIG. 5) and the board may not be constrained in height. If the board is constrained in height, then two layers circuit layers could be used to provide a compact assembly.

It should be noted that the antenna architecture described above in conjunction with FIG. 5 has the advantage that the phase shifter settings for the $i^{th}$ beam are independent of that from the $j^{th}$ beam, as was the case for the implementation of FIG. 1. The implementation of FIG. 5, furthermore, has the advantage that the phase shifter amplitude and phase errors as well as losses do not cascade. To form a beam, the signal from one antenna element propagates through only one phase shifter to form a beam before the signals for that beam are summed. Hence, the implementation of FIG. 5 is an inherently low loss implementation.

This implementation also has the advantage that the failure of one phase shifter only effects a single beam as a failure of only one element. Finally, for the implementation of FIG. 5, there is no coupling between the antenna beams. The power from beam i does not couple to beam j as it does in prior art techniques.

Although the implementation described above in conjunction with FIGS. 5 and 5A is for a receive array antenna, the technique described can just as well be used for a transmit array antenna.

It should also be noted that another feature of the embodiments of FIGS. 1, 2 and 5 above is the use of row boards perpendicular to the array to form independent fan beam outputs which are combined by column boards to finally form the independent pencil beams. This leads to a relatively easy construction of the multiple beam array antenna.

Figure 6:
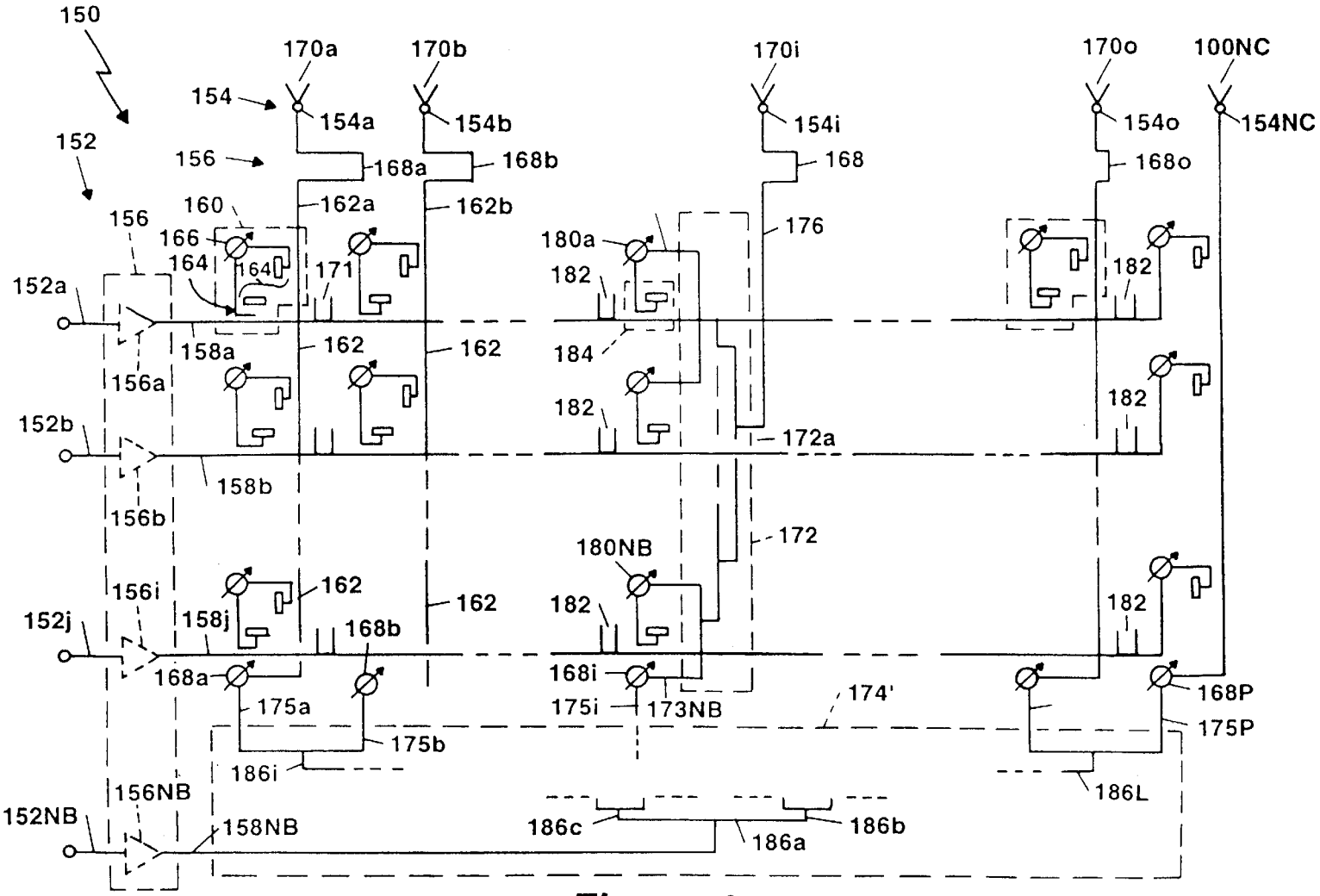
FIG. 6 are schematic diagrams of a single antenna row board having both series and corporate feed structures.

Referring now to FIG. 6, a beamformer board 150 for use in a transmit antenna system includes a plurality of beam-ports 152*a*–152NB generally denoted 152 and a plurality of antenna element ports 154*a*–154NC generally denoted 154. Each of the antenna element ports have a respective one of a plurality of antenna elements 170*a*–170NC generally denoted 170 coupled thereto.

Beamformer board 150 includes an amplifier circuit 156 which receives signals at input ports 152*a*–152NB and provides amplified output signals to respective ones of a plurality of signal paths 158*a*–158NB generally denoted 158. In one embodiment, amplifier circuit 156 is provided from a plurality of power amplifiers 156*a*–156NB.

A coupling element 160 couples a portion of the signal propagating along series signal path 158*a* to series signal path 162*a*. Coupling element 160 is disposed such that the phase shift introduced by the coupling element 160 into the signal coupled from signal path 158*a* to signal path 162*a* effects only a single antenna beam. This allows circuit 150 to be used to provide an antenna system which produces multiple independently steered beams.

The coupling element 160 may be provided, for example, as a beam/element grid junction similar to beam/element grid junction 100 described above in conjunction with FIG. 4. Those of ordinary skill in the art will appreciate of course that there are a variety of different ways in which the coupling/phase shifting function provided by coupling element 160 may be implemented.

In this case coupling element 160 includes a pair of line couplers 164 which may be provided as stripline, or microstrip couplers, for example, coupled to a phase shifter circuit as shown. It will be appreciated, of course, that the couplers 164 may be provided using any technique well known to those of ordinary skill in the art.

The signal fed from coupling element 160 to the signal path 162*a* propagates along the signal path 162*a* through a delay line 168*a* to beamformer port 154*a* and is subsequently emitted through antenna element 170*a*.

In addition to serial feed signal paths, 158, 162, beamformer board 150 may include parallel feed signal paths such as signal paths 172, 174. Parallel feed signal path 172 has an input port 172*a* coupled to a first end of signal path 176. A second end of signal path 176*a* is coupled to a first end of a delay 168*i*. A second end of the delay line 168*i* is coupled to port 154*i* and subsequently to antenna element 170*i*. Parallel feed circuit 172 also includes a plurality of output ports 173*a*–173NB. Each of the output ports are coupled a respective one of phase shifter circuits 180*a*–180NB.

Parallel feed signal path 172 includes a plurality of power divider circuits 178 coupled as shown to provide a 1 to NB power division. The power split of each power divider is selected to provide a particular weighting from each of the beam input ports 152*a*–152NB.

Coupled along each of the signal paths 158 are delay lines 182. The delay lines 182 are used to provide a predetermined phase compensation between each of the ports 154. The delays are used to compensate for delay dispersion across a row of the array when needed.

Parallel feed signal path 174 likewise includes a plurality of power divider circuits 186*a*–186NC generally denoted 186. Output ports 175 of power divider 174 are coupled to respective ones of phase shifters 168*a*–168$N_C$ as shown. When using the parallel feed 174 the delays 168 and 182 are not needed.

An embodiment of an array can use either serial feed circuits for paths 158 and 162 (thus yielding the embodiment of FIG. 1) or series feed circuits for path 158 and corporate feed circuits (e.g. a circuit similar to circuit 172) for path 162 or vice versa, or a corporate feed circuit (e.g. a circuit similar to circuit 174) for feed circuit 158 and for 162 a corporate feed circuit (e.g. a circuit similar to circuit 172) to yield the embodiment of FIG. 5.

A plurality of beamformer boards 150, may be appropriately coupled as described above in conjunction with FIG. 1 and FIG. 5 to thus provide a planar phased array antenna system. The phase shifter settings may be appropriately selected as discussed above in conjunction with FIG. 1 to provide a plurality of independently steered transmit antenna beams.

Figure 7:
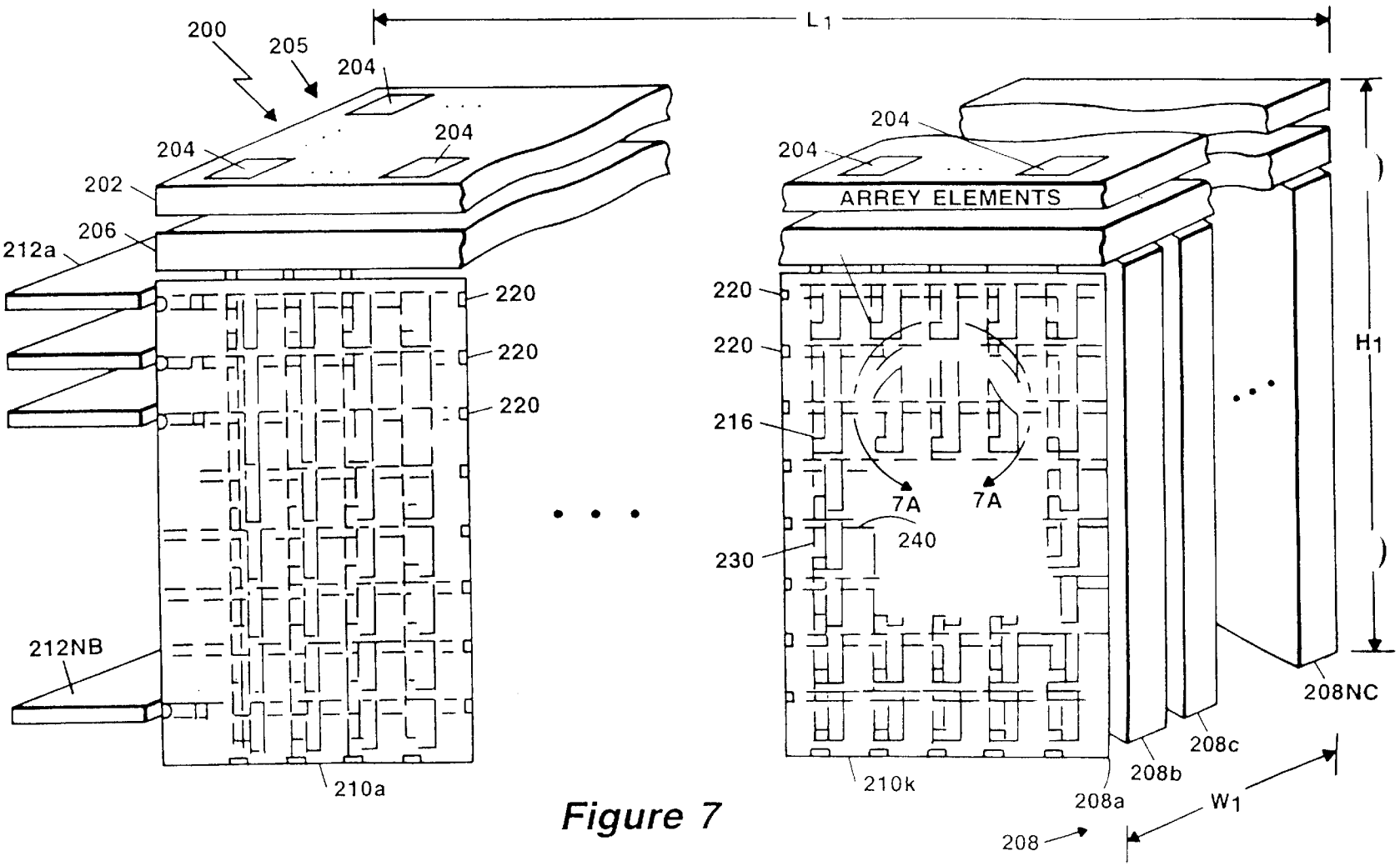
FIG. 7 is a block diagram of an antenna array including series feed circuits which provides multiple independently steered antenna beams.

Referring now to FIG. 7, an antenna array 200 includes a first printed circuit board 202 having a plurality of antenna elements 204 disposed thereon in an array pattern to thus provide an array of antenna elements 205. Array element board 202 is disposed over an optional element module interface board 206. Element module interface board 206 (if needed) provides a mechanical and electrical interface between the antenna array 205 on array element board 202 and feed circuits disposed on row boards 208*a*–208NR generally denoted 208.

In this particular embodiment, each of the row boards 208 is provided from a plurality of RF subarrays 210*a*–210K. Coupled to each of the row boards 208 is a corresponding one of a plurality of column boards 212*a*–212NB generally denoted 212. In one particular embodiment, the array of antenna elements 205 included in antenna system 200 is provided as an array of 75 columns×75 rows of antenna elements which are coupled to row boards 208 and column boards 212 to produce 8 independently-steered antenna beams. Thus in this case, 8 column boards 212 are required (i.e. NB=8) and 75 row boards 208 are required (i.e. NR=75).

To provide the antenna system 200 having 64 beams and a 75×75 antenna array elements, five RF subarrays 210*a*–210*k* each having 15 column elements and capable of producing 8 beams are coupled together to provide a single row board 208. Thus in this case, K is equal to five in FIG. 7.

Taking RF subarray 210K as representative of each of the RF subarrays 210, each of the RF subarrays includes a plurality of phase shifters 216 having a number of bits selected to provide a predetermined desired phase shift. For example, the phase shifters 216 may be provided as three bit phase shifters to provide a phase shift of 0° to 360° degrees in 45° steps.

The RF subarrays 210 may be provided from channeled microstrip on LTCC with transmission lines 230, 240 provided as embedded waveguides or strip line transmission lines.

Mating devices 220 provide connections between each of the subarrays 210*a*–210K. Mating devices 220 may be provided as waveguide, microstrip, coaxial or bond connections between each of the subarrays 210.

When antenna system 200 is provided having an operating frequency in the range of about 20 to about 30 gigahertz, and the antenna is manufactured using the aforementioned channelled microstrip on LTCC, a 75×75 element antenna array is provided having a length $L_1$, of about 20 inches, a height $H_1$ typically of about 2.5 inches, and a width $W_1$ typically of about 20 inches.

With each RF subarray 210 provided having 15 elements and 8 beams, the physical size of the subarray is about 4 inches in length, about 2.5 inches in height and about 0.15 inches in thickness and had a weight of about 0.1 pounds.

It should be noted that in this particular view, circuitry to provide DC power and array control is omitted for clarity.

Figure 7A:
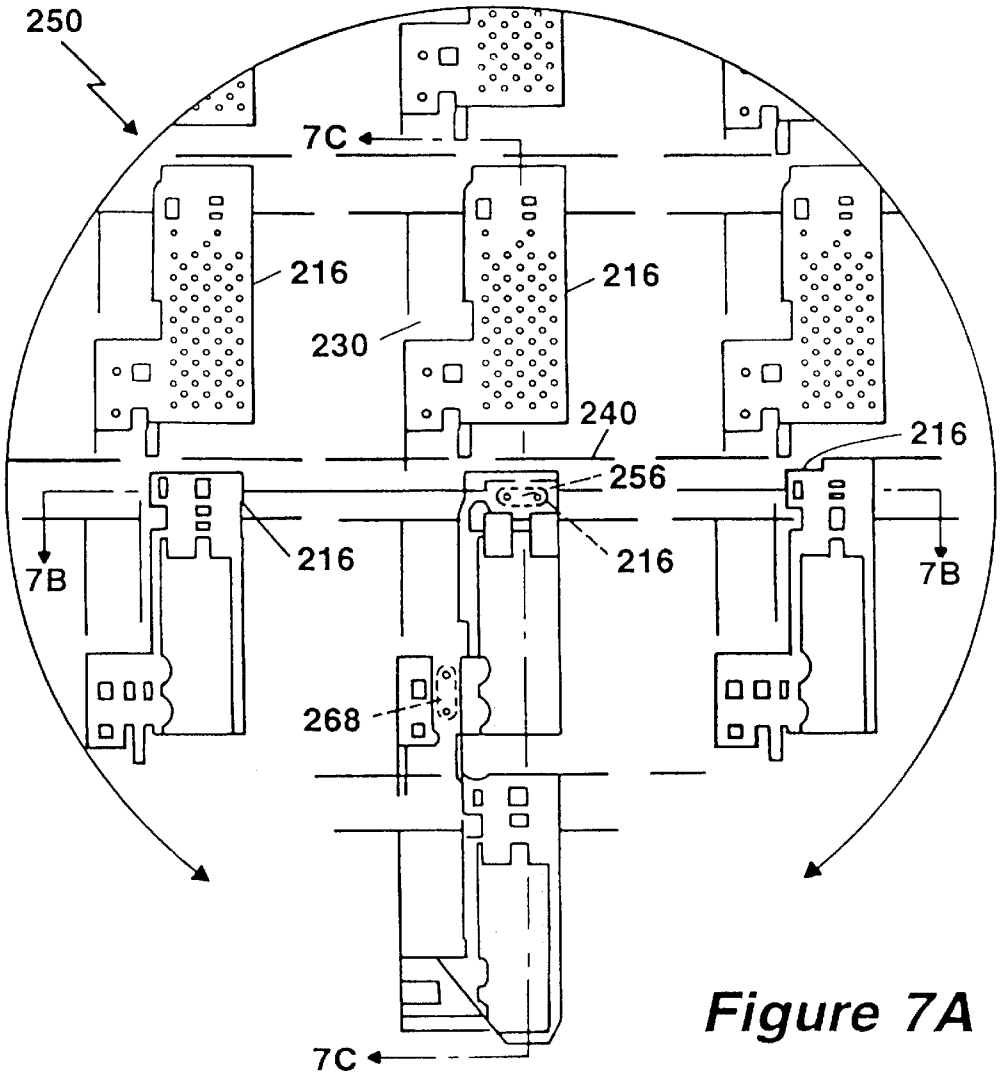
FIG. 7A is an enlarged portion of the antenna array taken along lines 7A—7A of FIG. 7.

Referring now to FIG. 7A, an enlarged portion of a section of subarray 210 is shown. In this enlarged view, phase shifters 216 are more clearly shown, disposed on the first transmission line 230 with the second transmission line 240 orthogonally disposed with respect to the first transmission line 230. In this manner, a plurality of crossed series feed circuits are provided. The transmission lines 230, 240 can be provided as imbedded waveguide or strip line transmission lines which present a relatively low insertion loss characteristic to signals propagating therein.

Figure 7B:
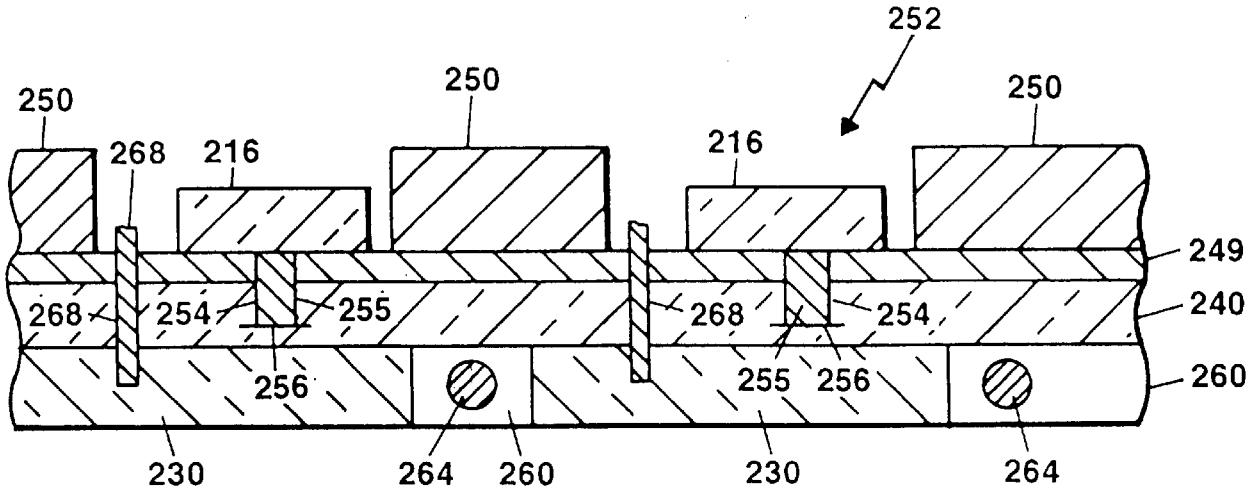
FIG. 7B is a cross-sectional view of the antenna array taken along lines 7B—7B in FIG. 7A.

Referring now to FIG. 7B, a cross-sectional view taken along a central longitudinal axis of transmission line 240 and across a transverse axis of phase shifter 216 and transmission line 230 is shown. A substrate 240 has disposed thereover a first conductor 249 and a plurality of conductive walls 250 which form a channeled microstrip transmission line 252. Disposed in the channeled microstrip transmission line are the phase shifters 216.

Each of the phase shifters 216 is coupled to a coupling loop 254 which is disposed in the embedded waveguide or strip line transmission lines 240. Coupling loop 254 includes a pair of posts 254 and a connecting member 256. Coupling loop 255 couples energy from the transmission line 240 to the phase shifter 216 such that a phase shift is introduced into a signal fed to the phase shifter 216. The transmission line 240 is disposed over a transmission line media 260 which is spaced between waveguides 230 and through which DC and logic wires or lines 264 are disposed.

Figure 7C:
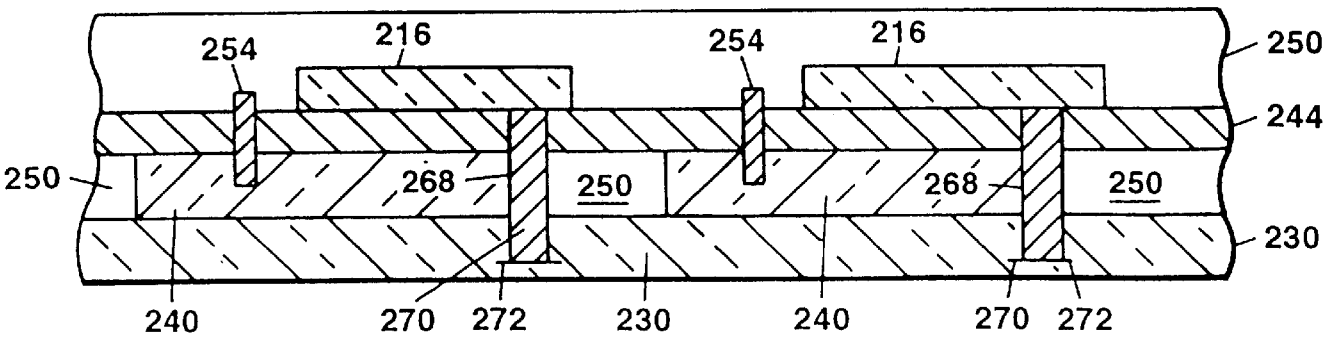
FIG. 7C is a cross-sectional view of the antenna array taken along lines 7C—7C in FIG. 7A.

Referring now to FIG. 7C, a cross-sectional view through a central longitudinal axis of transmission line 230 and across a transverse axis of the transmission line 240 is shown. Phase shifters 216 are disposed above a conductor 249. Coupling loops 254, 268 are disposed to couple energy from respective ones of the transmission line 230, 240. Coupling loops 268 include a pair of posts 270 and a connecting member 272. Coupling loops 268 couple energy from the transmission line 230 to the phase shifters 216 such that a phase shift is introduced into a signal fed to the phase shifter 216. In this particular implementation, transmission line 240 can provide a beam waveguide transmission line and transmission line 230 can provide an element waveguide transmission line.

Figure 8:
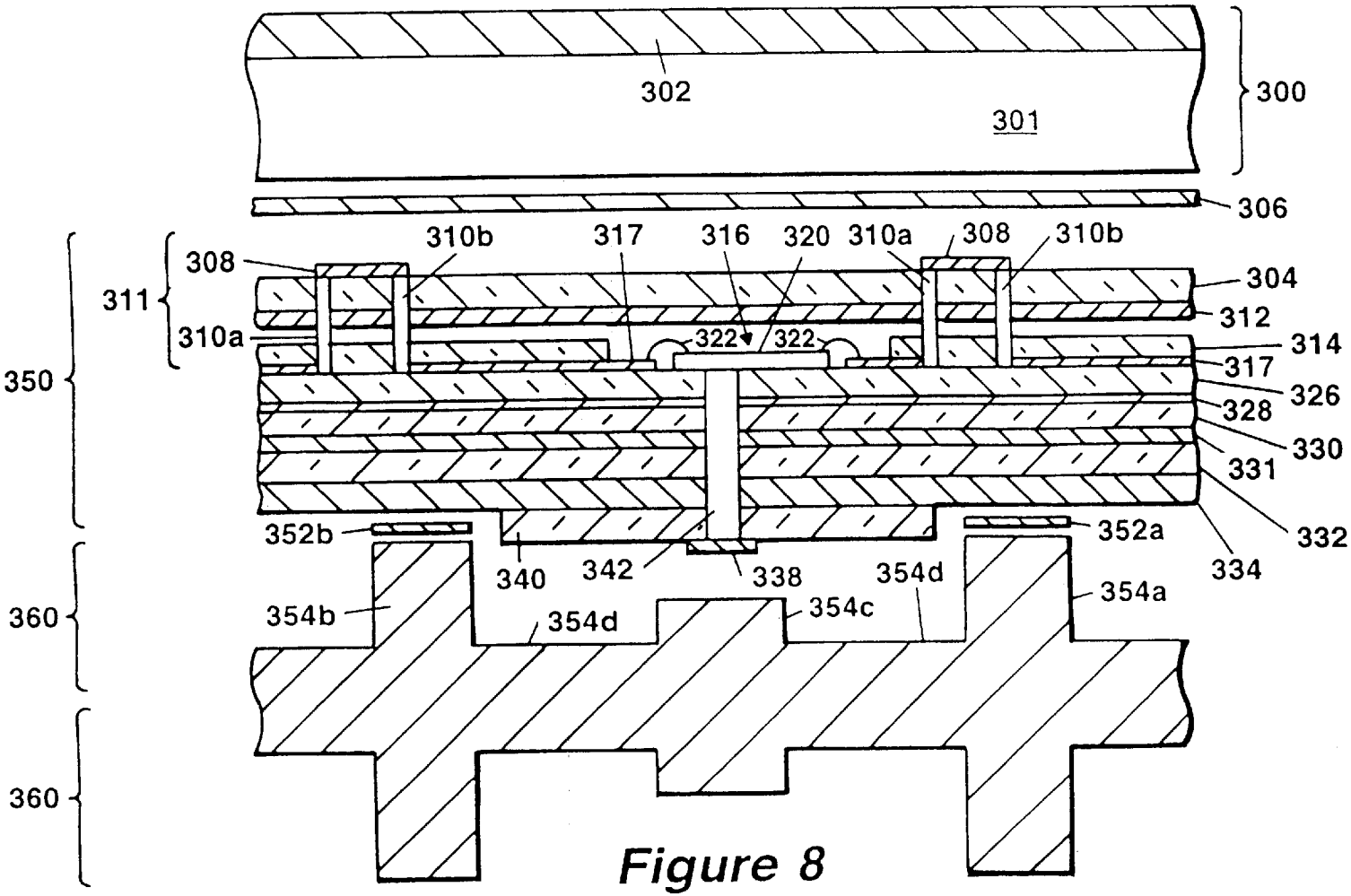
FIG. 8 is a cross-sectional view of a beamformer.
Figure 8A:
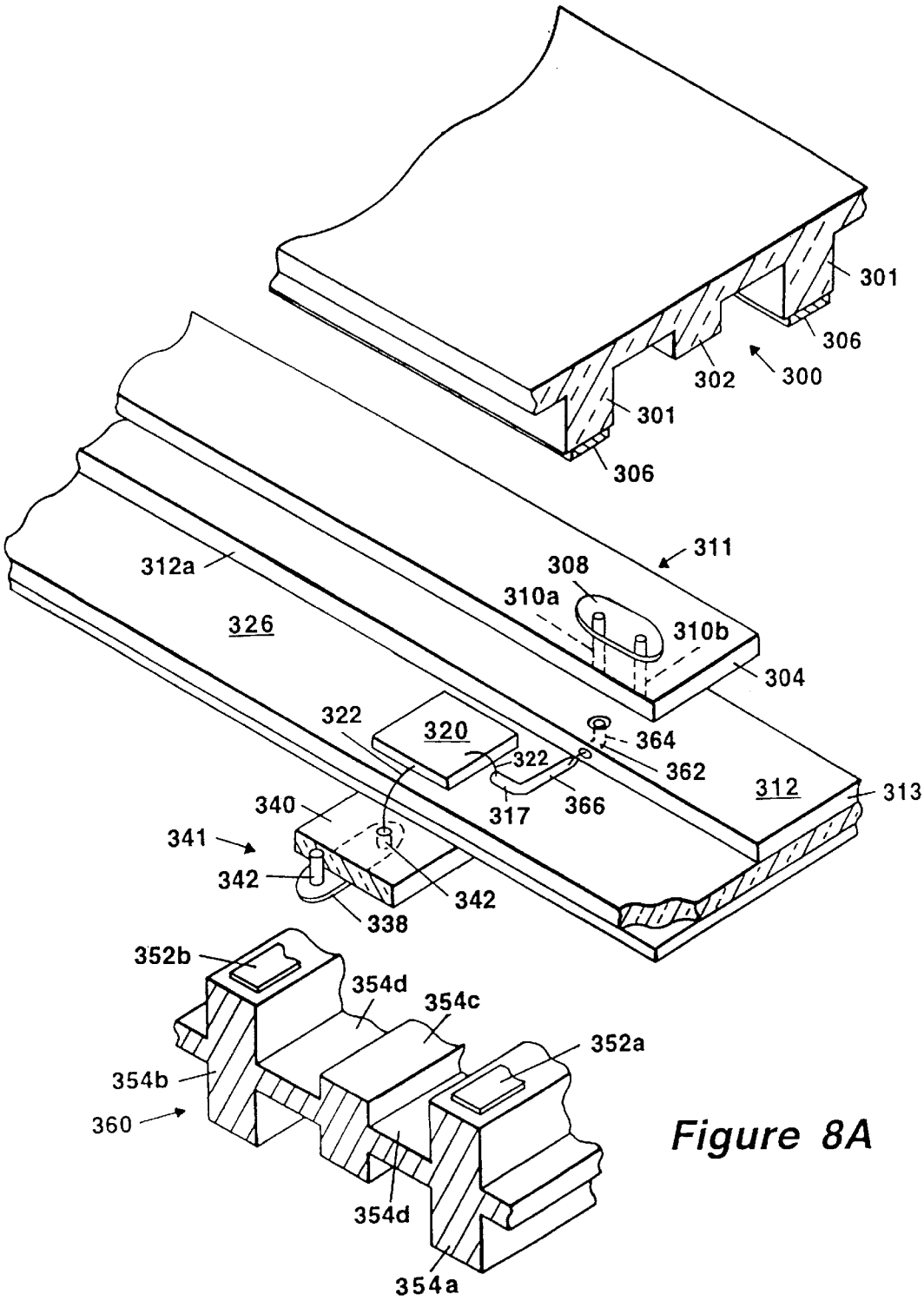
FIG. 8A is a perspective view of a beamformer.

Referring now to FIGS. 8 and 8A in which like elements are provided having like reference designations, a portion of a grid/element junction implemented using dielectric filled ridge waveguide is shown. FIG. 8 is a broken cross-sectional view of a ridge element waveguide 300 and a ridge beam waveguide 360 and FIG. 8A is a perspective view of the ridge element waveguide 300 and the ridge beam waveguide 360.

Turning now to FIGS. 8 and 8A, element waveguide 300 having sidewalls 301 and a ridge 302 is disposed over a dielectric slab 304. Dielectric slab 304 has a plurality of conductors 308 disposed thereon with each of the conductors 308 having a pair of conductive posts 310*a*, 310*b* coupled thereto. Conductors 308 provide an electrical connection between the posts 310*a*, 310*b*. Conductors 308 and posts 310*a*, 310*b* form a coupling loop 311 (FIG. 8A). As can be seen in FIG. 8A, in a preferred embodiment, conductor 308 is disposed along a central longitudinal axis of waveguide 300.

A conductive bond film 306 adheres the sidewall 301 of waveguide 300 to a conductive surface 312 which forms the bottom wall of the waveguide 300. The conductive surface 312 is disposed over a first surface of the dielectric slab 304. Conductive surface 312 may be formed a number of different ways. For example, as illustrated in FIG. 8, conductive surface 312 may be provided as a conductive layer (e.g. a sheet of appropriately processed or treated copper or other conductive material) adhered or otherwise disposed on the surface of dielectric slab 304. Alternatively, as illustrated in FIG. 8A, conductive surface 312 can be formed by plating stripline circuit board 313 (FIG. 8A).

Conductive surface 312 is disposed over a dielectric layer 314 having an opening 316 therein. Disposed in opening 316 is a phase shifter integrated circuit chip 320 which is coupled via a bond wire 322 to a signal path 317. The signal path 317 is here provided as a conductor disposed over a first surface of a dielectric 326 having a conductive layer 328 disposed over a second opposing surface thereof. Conductive layers 312 and 328 correspond to ground plane layers and layer 317 corresponds to a circuit layer in which radio frequency (RF) (including microwave and millimeter wave) signals can propagate.

Disposed under the conductive layer 328 is a second dielectric layer 330. A conductive layer 331 in which DC and logic signals may propagate is disposed over a surface of dielectric 330. A dielectric layer 332 is disposed over layer 331 and a ground plane layer 334 is disposed over layer 332. A dielectric slab 340 having a plurality of conductors 338 disposed thereon is disposed over layer 334. A pair of conductive posts 342 (only one post 342 being visible in FIG. 8) are disposed through dielectric slab 340 and conductor 338 provides an electrical connection between the posts 342. Conductor 338 and posts 342 thus form a coupling loop 341 (FIG. 8A).

Dielectric 304, conductor 312, couplers 311, dielectric 314, conductor 317, dielectric 326, conductor 328, dielectric 330, conductor 331, dielectric 332, conductor 334 and conductor 338, dielectric 340 and coupling loop 341 form a microwave circuit assembly 350. The microwave circuit assembly 350 is disposed over the beam waveguide 360 which is provided as a ridge waveguide 354 formed by surfaces of waveguide walls 354*a*, 354*b*, 354*d* and surfaces of ridge 354*c* as shown in FIG. 8. The conductive layer 334 thus forms a wall of the waveguide 354.

It should be noted that, in an effort to promote clarity in the description, only a limited number of circuit layers are shown in FIGS. 8 and 8A. In some applications it may be desirable or even necessary to utilize additional circuit layers. Such additional circuit layers may be desired or required to provide signal paths for transmission of, for example, DC and logic signal. Those of ordinary skill in the art, after reading the description hereinbelow will appreciate how, why and when to add additional circuit layers and the purpose of the additional circuit layers. Also, to show alternate techniques for implementing the circuits, it should be noted that there are slight differences between the implementations of FIG. 8 and FIG. 8A.

A pair of conductive layers 352*a*, 352*b* which may be provided as conductive bond films similar to conductive bond film 306 are disposed over waveguide walls 354*a*, 354*b*. When assembled, the dielectric slab 340 is disposed in an internal portion of the waveguide 354 and thus provides beam waveguide 360 as a dielectric loaded ridge waveguide 354. The upper assembly provided by beam waveguide 360, microwave circuit assembly 350 and upper element waveguide 300 is repeated on the lower portion of beam guide 360 as indicated in FIG. 8.

In general overview, coupling loops 311, 341 couple energy from a first one of the waveguides 300 and 360 through the phase shifter 320 to a second one of the waveguides 300 and 360. The operation of coupling loops 311, 341 and phase shifter 320 can be more easily explained with reference to FIG. 8A. It should be noted that the exemplary implementation described in conjunction with FIG. 8A is only illustrative and should not be construed as limiting.

As can be seen in FIG. 8A, signals propagating in the dielectric-loaded waveguide 300 are coupled by coupling loop 311. Printed circuit board 313 is provided as a multilayer printed circuit board having conductive surfaces 312, 312*a*. The printed circuit board 313 includes a transmission line 362. A first end of the transmission line 362 is coupled through an RF feedthrough 364 to the post 310*a* of coupling loop 311. The posts 310*a*, 310*b* may be formed as plated through holes in dielectric 304. Thus, care must be taken not to provide a short circuit signal path between post 310*a* and conductive surface 312. This may be accomplished, for example, by removing conductive material from the region where the RF feedthrough 364 mates with the conductive post 310*a*. Conductive post 310*b* is coupled to a termination.

A second end of transmission line 362 is coupled to a second transmission line 366 which leads to transmission line 317. The bond wire 322 or other appropriate electrical connection couples the signal path 317 to phase shifter 320. It should be noted that transmission line 362 is provided as a stripline transmission line while transmission line 366 is provided as a microstrip transmission line. Thus a stripline-to-microstrip transition is required to provide a relatively well-matched, low insertion loss connection between the signal paths 362, 366. Similarly, a second bond wire 322 couples phase shifter 320 to coupling element 341 as shown. Thus signals propagating in waveguide 300 may be coupled via coupling loop 311 through phase shifter 320 and into waveguide 360 via coupling loop 341.

Figure 9:
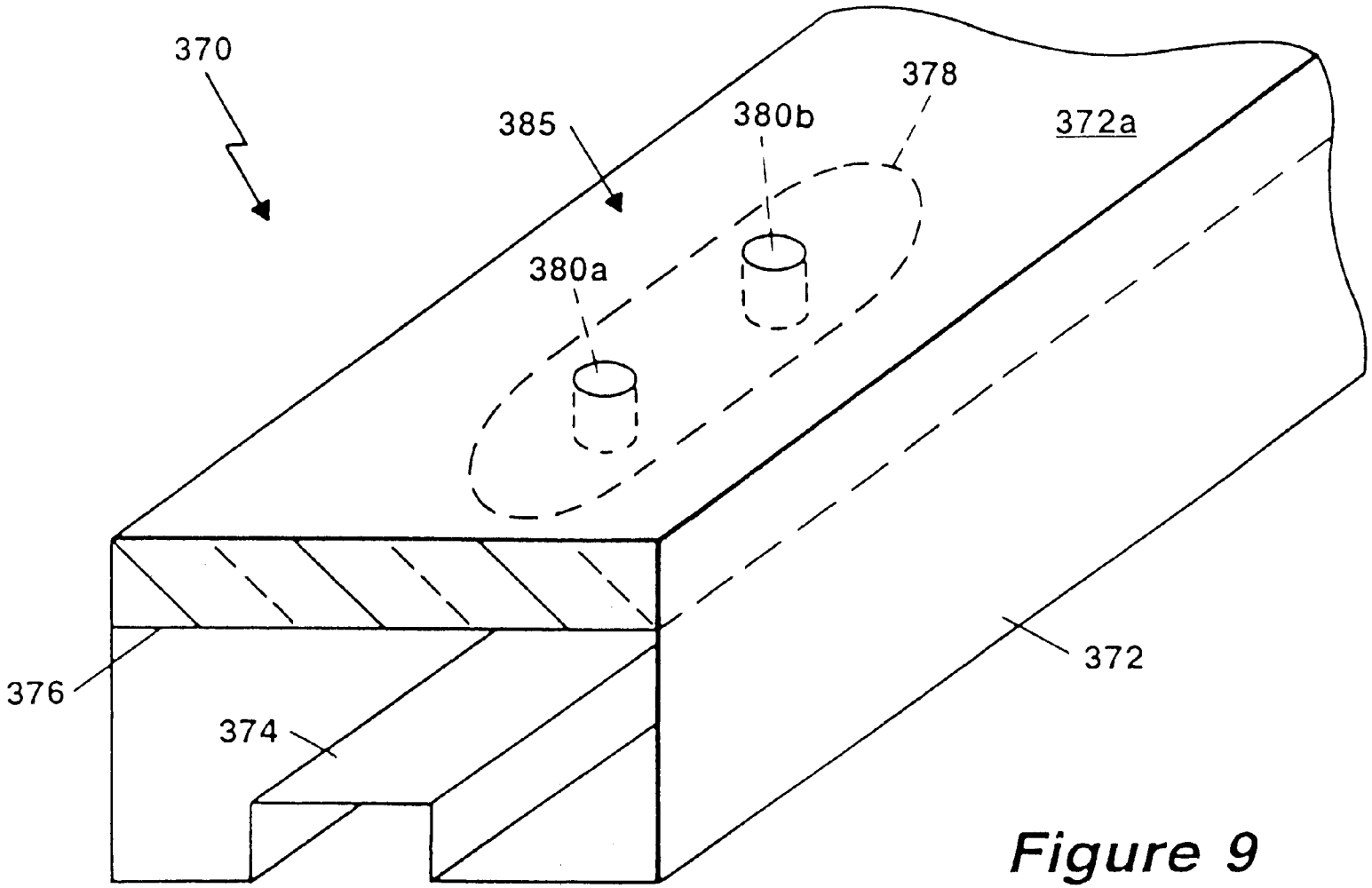
FIG. 9 is a perspective view of a waveguide coupler.

Referring now to FIG. 9, a dielectric-loaded ridge waveguide 370 includes waveguide 372 having a ridge 374 disposed along a central longitudinal axis thereof. A dielectric loading material 376 is disposed on an inner wall of waveguide 372. Disposed on a lower portion of dielectric 376 is a strip conductor 378 here provided having an oval shape. A pair of conductive posts 380*a*, 380*b* are disposed through the upper waveguide wall 372*a* and through dielectric 376 and contact the conductive strip 378. The conductive posts and conductive strip 378 form a coupling element 385. The conductive post 380*a*, 380*b* may be provided, for example, as plated through holes.

Coupling element 385 may be used, for example, in the phased array antenna systems described above to couple energy from the waveguide transmission lines of FIGS. 8 and 8A into phase shifters as described above.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. An RF circuit comprising:

a first directional coupler having a first port, a second port, a third port and a fourth port;

a phase shifter having a first port coupled to the third port of said first directional coupler and having a second port;

a second directional coupler having a first port coupled to the second port of said phase shifter and having a second port, a third port and a fourth port;

an antenna element coupled to the first port of said first coupler;

a first termination coupled to the second port of said first directional coupler; and a second termination coupled to the third port of said second directional coupler.

2. The RF circuit of claim 1 further comprising a transmitter coupled to the fourth port of said second directional coupler.

3. The RF circuit of claim 2 further comprising:

a first signal path coupled between said antenna element and the first port of said first coupler; and a second signal path coupled between the fourth port of said second directional coupler and said transmitter.

4. The RF circuit of claim 3 further comprising:

a signal combiner having an input port coupled to the second end of said second signal path and having an output port; and a receiver having an input port coupled to the output port of said signal combiner.

5. The RF circuit of claim 1 further comprising a further directional coupler connected to the second port of the second directional coupler.

6. The RF circuit of claim 1 further comprising a further directional coupler connected to the fourth port of the first directional coupler.

7. A system for steering multiple antenna beams independently, comprising:

first, second, third, and fourth RF circuits each including a first directional coupler having a first port, a second port, a third port and a fourth port;

a phase shifter having a first port coupled to the third port of said first directional coupler and having a second port;

a second directional coupler having a first port coupled to the second port of said phase shifter and having a second port, a third port and a fourth port;

an antenna element coupled to the first port of said first coupler;

a first termination coupled to the second port of said first directional coupler; and a second termination coupled to the third port of said second directional coupler, wherein the second port of the second directional coupler of the first RF circuit is coupled to the fourth port of the second directional coupler of the second directional coupler, the fourth port of the first directional coupler of the first RF circuit is coupled to the first port of the first directional coupler of the third directional coupler, the fourth port of the first directional coupler of the second RF circuit is coupled to the first port of the first directional coupler of the fourth RF circuit, and the second port of the second directional coupler of the third RF circuit is coupled to the fourth port of the second directional coupler of the third RF circuit.

8. The system according to claim 7, wherein the respective antenna elements form an array having a plurality of columns and a plurality of rows.

9. The system according to claim 8, wherein the respective antenna elements provide a phased array.

* * * * *

UNITED STATES PATENT AND TRADEMARK OFFICE

CERTIFICATE OF CORRECTION

PATENT NO. : 6,232,920 B1
DATED : May 15, 2001
INVENTOR(S) : Brookner et al.

It is certified that error appears in the above-identified patent and that said Letters Patent is hereby corrected as shown below:

Column 1,
Line 5, delete “is continuation” and replace with -- is a continuation --.
Line 12, delete “1. Field of the Invention” and replace with
-- FIELD OF THE INVENTION --.
Line 15, delete “2. Background of the Invention” and replace with
-- BACKGROUND OF THE INVENTION --.
Line 39, delete “of a” and replace with -- of as a --.

Column 3,
Line 35, delete “to second” and replace with -- to a second --.
Line 37, delete “paths coupled” and replace with -- paths is coupled --.
Line 37, delete “plurality a” and replace with -- plurality of --.
Line 48, delete “$i^{ith}$” and replace with -- $i^{th}$ --.

Column 5,
Line 4, delete “1a-14N” and replace with -- 14a-14N --.

Column 6,
Line 6, delete “circuit 20” and replace with -- circuit $20_{a,1}$ --.
Line 13, delete “$24_{a,1}$” and replace with -- $24_{1,1}$ --.
Line 28, delete “$12_{1,3}$-$20_{NC}$ ” and replace with -- $12_{1,3}$-$20_{1,NC}$ --.

Column 10,
Line 31, delete “100a” and replace with -- 110a --.
Line 37, delete “possible fed” and replace with -- possibly fed --.

Column 11,
Line 1, delete “100d” and replace with -- 110d --.

Column 12,
Line 63, delete “layers circuits layers” and replace with -- circuit layers --.
Line 67, delete “$i^{ith}$” and replace with -- $i^{th}$ --.

Column 14,
Line 64, delete “210a-210k” and replace with -- 210a-210K --.

UNITED STATES PATENT AND TRADEMARK OFFICE

CERTIFICATE OF CORRECTION

PATENT NO. : 6,232,920 B1
DATED : May 15, 2001
INVENTOR(S) : Brookner et al.

It is certified that error appears in the above-identified patent and that said Letters Patent is hereby corrected as shown below:

Column 15,
Line 8, delete "from channeled" and replace with -- from a channeled --.
Line 27, delete "had" and replace with -- has --.

Signed and Sealed this

First Day of October, 2002

*Attest:*

*Attesting Officer*

JAMES E. ROGAN
*Director of the United States Patent and Trademark Office*